US008027628B2

(12) United States Patent
Watanabe et al.

(10) Patent No.: US 8,027,628 B2
(45) **Date of Patent: *Sep. 27, 2011**

(54) CLEANING DEVICE, PROCESS CARTRIDGE, AND IMAGE FORMING APPARATUS

(75) Inventors: Kazuhiko Watanabe, Tokyo (JP); Masahiko Shakuto, Kanagawa (JP); Osamu Naruse, Kanagawa (JP); Hidetosi Yano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/178,334

(22) Filed: Jul. 23, 2008

(65) Prior Publication Data

US 2008/0286020 A1 Nov. 20, 2008

Related U.S. Application Data

(62) Division of application No. 11/261,515, filed on Oct. 31, 2005, now Pat. No. 7,415,238.

(30) Foreign Application Priority Data

Nov. 1, 2004 (JP) ..... 2004-317637
Aug. 11, 2005 (JP) ..... 2005-232763

(51) Int. Cl.
*G03G 21/00* (2006.01)

(52) U.S. Cl. ..... 399/350; 399/351

(58) Field of Classification Search ..... 399/350–351
See application file for complete search history.

(56) References Cited

U.S. PATENT DOCUMENTS

| | | | |
|---|---|---|---|
| 4,639,123 | A | 1/1987 | Adachi et al. |
| 5,937,228 | A | 8/1999 | Shoji et al. |
| 5,999,773 | A | 12/1999 | Yasutomi et al. |
| 6,366,751 | B1 | 4/2002 | Shakuto et al. |
| 6,560,427 | B2 | 5/2003 | Kubo et al. |
| 6,625,409 | B2 | 9/2003 | Shakuto et al. |
| 6,654,579 | B2 | 11/2003 | Shakuto et al. |
| 6,799,012 | B2 | 9/2004 | Shakuto et al. |
| 6,853,822 | B2 | 2/2005 | Yano et al. |
| 7,369,807 | B2 | 5/2008 | Naruse et al. |
| 2002/0021922 | A1 | 2/2002 | Katoh et al. |
| 2002/0028100 | A1 | 3/2002 | Kubo et al. |
| 2002/0081128 | A1 | 6/2002 | Shakuto et al. |
| 2002/0090229 | A1 | 7/2002 | Shakuto et al. |
| 2003/0039494 | A1 | 2/2003 | Shakuto et al. |
| 2003/0157419 | A1 | 8/2003 | Miyakawa et al. |
| 2004/0101772 | A1 | 5/2004 | Zhu et al. |

(Continued)

FOREIGN PATENT DOCUMENTS

CN 1338667 A 3/2002

(Continued)

OTHER PUBLICATIONS

English Translation of JP 06332350 to ENDO.*
Machine Translation of JP2002268487 Tomiyama et al.

*Primary Examiner* — Ryan Walsh
(74) *Attorney, Agent, or Firm* — Oblon, Spivak, McClelland, Maier & Neustadt, L.L.P.

(57) ABSTRACT

A blade, including: a cut surface provided by obliquely cutting a part of a tip surface to set an angle forming a tip ridge portion of the blade as an obtuse angle, wherein the tip ridge portion is configured to be pressed to a surface to be cleaned.

20 Claims, 19 Drawing Sheets

U.S. PATENT DOCUMENTS

| | | | |
|---|---|---|---|
| 2004/0105702 | A1 | 6/2004 | Kurotori et al. |
| 2004/0105710 | A1 | 6/2004 | Shakuto et al. |
| 2004/0265024 | A1 | 12/2004 | Naruse et al. |
| 2005/0058474 | A1 | 3/2005 | Watanabe et al. |
| 2005/0100375 | A1 | 5/2005 | Naruse et al. |

FOREIGN PATENT DOCUMENTS

| | | | |
|---|---|---|---|
| CN | 1420393 | A | 5/2003 |
| CN | 1519655 | A | 8/2004 |
| JP | 61-151680 | | 7/1986 |
| JP | 2-55270 | | 4/1990 |
| JP | 2-106780 | | 4/1990 |
| JP | 5-19671 | | 1/1993 |
| JP | 6-332350 | | 12/1994 |
| JP | 6-342253 | | 12/1994 |
| JP | 11-065155 | | 3/1999 |
| JP | 11-237819 | | 8/1999 |
| JP | 2962843 | | 8/1999 |
| JP | 2000-75527 | | 3/2000 |
| JP | 2002-268487 | | 9/2002 |
| JP | 2003-241408 | | 8/2003 |
| JP | 2004-46145 | | 2/2004 |
| JP | 2004-138643 | | 5/2004 |
| JP | 2004-198552 | | 7/2004 |
| JP | 2004-272019 | | 9/2004 |
| JP | 2005-10576 | | 1/2005 |
| JP | 2005-148403 | | 6/2005 |

* cited by examiner

OUTER PERIPHERAL LENGTH : L1

COMPLETE ROUND WITH AREA S

CLEANING DEVICE, PROCESS CARTRIDGE, AND IMAGE FORMING APPARATUS

CROSS-REFERENCE TO RELATED APPLICATIONS

The present divisional application claims the benefit of priority under 35 U.S.C. §120 to application Ser. No. 11/261,515, filed on Oct. 31, 2005, now U.S. Pat. No. 7,415,238 and under 35 U.S.C. §119 from Japanese Applications Nos. 2004-317637, filed in Japan on Nov. 1, 2004, and 2005-232763, filed in Japan on Aug. 11, 2005, the entire contents of each of which are hereby incorporated herein by reference.

BACKGROUND OF THE INVENTION

1. Field of the Invention

The present invention relates to a cleaning device that removes a toner remaining on an image carrier of an image forming apparatus after image transfer.

2. Description of the Related Art

Conventionally, in an electrophotographic image forming apparatus, while an image carrier is rotating, a charging device uniformly charges a peripheral surface of the image carrier, an exposing device performs writing to form an electrostatic latent image on the image carrier, a developing device deposits a toner to visualize the electrostatic latent image, and forms a toner image on the image carrier. A transfer device transfers the toner image to a recording medium, and a fixing device fixes the transferred image onto the recording medium. After the transfer of the toner image, a cleaning device cleans the peripheral surface of the image carrier to prepare for the next image formation.

A cleaning blade made of an elastic material like polyurethane rubber is used as a cleaning member in the cleaning device so as to simplify the structure and achieve excellent cleaning performance. In the cleaning device, a support member supports a base end of the cleaning blade, and presses a tip ridge portion of the cleaning against the peripheral surface of the image carrier to scrape off a toner remaining on the image carrier.

Meanwhile, there has been an increasing demand for improvement of image quality in this type of electrophotographic image forming apparatus. To meet such demand, toner particles have been reduced in size and made spherical. Accordingly, a spherical toner formed by using a polymerizing method has become mainstream.

However, when toner particles are reduced in size and made spherical, it is difficult to completely remove a residual toner with the cleaning blade. This is because a rotation moment is generated in the toner at a position on the image carrier against which the cleaning blade is pressed. The rotation moment pushes the cleaning blade up to let the toner to slip into a space between the cleaning blade and the image carrier.

Therefore, when the toner having small and spherical toner particles is used, it is necessary to increase pressing force of the cleaning blade against the image carrier to prevent the toner from slipping into the space between the cleaning blade and the image carrier. In general, "linear pressure" has been used to represent a force for preventing the toner from slipping into the space under the cleaning blade. The "linear pressure" [gf/cm] calculated by dividing a total load applied to the cleaning blade by a length of the tip ridge portion of the cleaning blade pressed against the image carrier.

Specifically, a tip of the cleaning blade is pressed against the image carrier such that the tip portion of the blade comes into a stick state. A sheet-like sensor with a thickness of 0.1 millimeter is placed in a position where the cleaning blade is pressed against the image carrier. The "linear pressure" is calculated by dividing output of the sensor (a load [g] acting on the position) by a length [cm] in an axial direction of the image carrier of the position.

Note that the sheet-like sensor includes a large number of electrodes arranged in two directions (a row direction and a column direction) orthogonal to each other. Surfaces of the electrodes are covered with film resin. In the electrodes, a pressure sensitive resistive substance and a charge generating substance are set in a lattice shape. When an external pressure is applied to intersections of the lattice shape, resistance changes according to a load of the external pressure. The change in the resistance appears as a change in a current flowing in the row direction and the column direction. Thus, a total load is calculated from the current.

An increased "linear pressure" improves cleaning performance for a toner having small and spherical toner particles that are difficult to clean off. However, an increase in linear pressure causes harmful effects. For example, abrasion of the image carrier increases, torque of the image carrier increases, and abrasion of the cleaning blade increases.

Moreover, the ability of preventing a toner from slipping into the space under the cleaning blade cannot be sufficiently evaluated with the linear pressure. In reality, a nip is formed between the cleaning blade and the image carrier at the position where the cleaning blade is pressed against the image carrier. Specifically, the cleaning blade is not in line contact, but in surface contact with the image carrier. However, as described above, the "linear pressure" is calculated by dividing a total load applied to the cleaning blade by a length in an axial direction of the image carrier of the position where the cleaning blade is pressed against the image carrier. Therefore, a contact area of the cleaning blade with the image carrier is not taken into account at all.

Thus, it is not always possible to clean the toner having small and spherical toner particles simply by increasing the "linear pressure". Instead, harmful effects are caused by an increased linear pressure.

One approach is to use a "surface pressure" as a characteristic representing a force for preventing a toner from slipping into the space between the cleaning blade and the image carrier. The surface pressure is calculated by dividing a total load applied to the cleaning blade by a contact area of the cleaning blade with the image carrier. Even when the same load is applied to the cleaning blade, a contact area of the cleaning blade with the image carrier changes according to hardness, thickness, free length, and a shape of the cleaning blade. The "surface pressure" fluctuates according to the contact area, a material and a shape of the cleaning blade, a method of supporting the cleaning blade, and the like.

FIG. 19A depicts a cleaning blade 1*a* and FIG. 19B depicts a cleaning blade 1*b* with different shapes. The cleaning blade 1*a* has a planar shape, and is supported by a support member 2. A base end of the cleaning blade 1*a* adheres onto one side of the support member 2. A tip ridge portion 3*a* of the cleaning blade 1*a* is pressed against an image carrier 4. The cleaning blade 1*b* has a projected portion 5, and is supported by the support member 2. A base end of the cleaning blade 1*b* adheres onto one side of the support member 2. A tip ridge portion 3*b* of the cleaning blade 1*b* is pressed against the image carrier 4. In this case, the projected portion 5 abuts against the support member 2 to prevent the cleaning blade 1*b* from bending and the blade tip from being pushed away.

When a load is applied to the cleaning blade 1*a*, the cleaning blade 1*a* is deformed as shown in FIG. 19A. At a tip position of the support member 2, buckling is caused by concentration of stress. As a result, as shown in FIG. 20A, a tip "a" of the cleaning blade 1*a* curls back and a trunk portion "b" near the tip of the cleaning blade 1*a* comes into contact with a peripheral surface of the image carrier 4. Consequently, as shown in FIG. 21A, the load is dispersed and pressure distribution becomes small.

On the other hand, even if a load is applied to the cleaning blade 1*b*, the cleaning blade 1*b* is not deformed significantly as shown in FIG. 19B. As shown in FIG. 20B, the cleaning blade 1*b* is pressed against the image carrier 4 at a curled tip portion of the cleaning blade 1*b*, and a trunk portion of the cleaning blade 1*b* does not contact the image carrier 4. Consequently, as shown in FIG. 21B, a large pressure distribution with stress concentrated on the tip of the cleaning blade 1*b* is obtained.

Accordingly, depending on the shape of the cleaning blade, a contact area of the cleaning blade with the image carrier changes, and a surface pressure changes. This results in a difference in cleaning performance.

Japanese Patent Application Laid-Open No. 2000-75527 and Japanese Patent Application Laid-Open No. H11-237819 disclose cleaning devices that take a surface pressure into account. Japanese Patent Application Laid-Open No. 2002-268487 and Japanese Patent Application Laid-Open No. H5-19671 disclose cleaning devices that have an obtuse-angled blade edge. Japanese Patent Application Laid-Open No. H6-332350 discloses a cleaning device having a round blade edge with a curvature of 5 micrometers (μm) to 15 μm. Japanese Patent No. 2962843 discloses a cleaning device having a tapered blade.

However, none of the patent documents described above refers to a cleaning configuration that cleans off a toner of small and spherical particles with a low linear pressure and a high surface pressure.

SUMMARY OF THE PRESENT INVENTION

It is an object of the present invention to at least solve the problems in the conventional technology.

According to an aspect of the present invention, a cleaning device for cleaning off a toner from a surface of a member rotating in a first direction includes a blade made of an elastic material including a tip portion that is pressed against the surface in a second direction counter to the first direction, the tip portion including a slanting portion, and a supporter that supports the blade, wherein an angle between the slanting portion and a longitudinal direction of the blade is obtuse, and the slanting portion is pressed against the surface at a surface pressure of 2.0 MPa or more.

According to another aspect of the present invention, a process cartridge that is detachably attachable to an image forming apparatus includes a cleaning device for cleaning off a residual toner remaining on a surface of an image carrier rotating in a first direction after image transfer is performed, including a blade made of an elastic material including a tip portion that is pressed against the surface in a second direction counter to the first direction, the tip portion including a slanting portion, and a supporter that supports the blade, wherein an angle between the slanting portion and a longitudinal direction of the blade is obtuse, and the slanting portion is pressed against the surface at a surface pressure of 2.0 MPa or more, wherein the cleaning device and the image carrier are combined.

According to still another aspect of the present invention, an image forming apparatus includes a cleaning device for cleaning off a residual toner remaining on a surface of an image carrier rotating in a first direction after image transfer is performed, including an blade made of an elastic material including a tip portion that is pressed against the surface in a second direction counter to the first direction, the tip portion including a slanting portion, and a supporter that supports the blade, wherein an angle between the slanting portion and a longitudinal direction of the blade is obtuse, and the slanting portion is pressed against the surface at a surface pressure of 2.0 MPa or more.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of the present invention will be described below with reference to accompanying drawings. The present invention is not limited to these embodiments.

Figure 1:
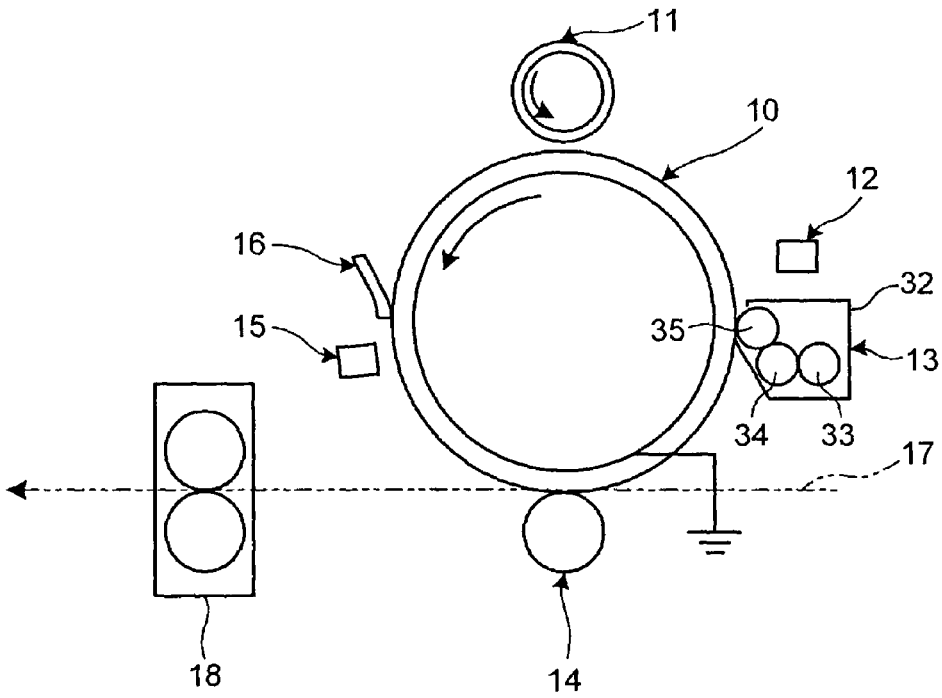
FIG. 1 is a schematic internal diagram of a monochrome image forming apparatus of a direct transfer system including a cleaning device according to the present invention.

A monochrome image forming apparatus of a direct transfer system including a cleaning device according to the present invention is shown in FIG. 1.

Reference numeral 10 denotes an image carrier, which has a drum shape in this embodiment but can have a belt shape. The image carrier 10 rotates clockwise in the figure. Around the image carrier 10, clockwise from a charging device 11 on the upper side, an exposing device 12 and a developing device 13 are arranged to the right side, a transfer device 14 is arranged on the lower side, and an electricity eliminating device 15, a cleaning device 16, and the like are arranged on the left side. On the lower side of the image carrier 10, a recording-medium conveyance path 17 that conveys a recording medium such as a sheet or an OHP film from the right side to the left side through a transfer position between the image carrier 10 and the transfer device 14 is provided. In the recording-medium conveyance path 17, a fixing device 18 is provided downstream with respect to the transfer position.

According to rotation of the image carrier 10, the image forming apparatus uniformly charges a peripheral surface of the image carrier 10 in a predetermined polarity with the charging device 11 while rotating a charging member of a roller shape. Subsequently, the image forming apparatus performs writing to form an electrostatic latent image on a charged area of the image carrier 10 with the exposing device 12. Thereafter, the image forming apparatus deposits a toner to visualize the electrostatic latent image and form a toner image on the image carrier 10 with the developing device 13.

The image forming apparatus conveys a recording medium, which is sent out from a not-shown sheet feeding cassette or the like, through the recording-medium conveyance path 17. The recording medium is sent to the lower side of the image carrier 10 at a timing to coincide with rotation of the image carrier 10 so that a position of the recording medium matches the toner image on the image carrier 10. At the transfer position, the image forming apparatus transfers the toner image on the image carrier 10 to the recording medium with the transfer device 14 while conveying the recording medium. The image forming apparatus mechanically separates the recording medium having the toner image transferred thereon from the image carrier 10 and continues to convey the recording medium through the recording-medium conveyance path 17. The image forming apparatus fixes the transferred image with the fixing device 18 in a downstream position and discharges the recording medium to a not-shown discharge stack device.

The image forming apparatus eliminates electricity from the peripheral surface of the image carrier 10 after the image transfer with the electricity eliminating device 15. The image forming apparatus removes a residual toner remaining on the image carrier 10 after the image transfer with the cleaning device 16 to prepare for the next image formation to be started.

Figure 2:
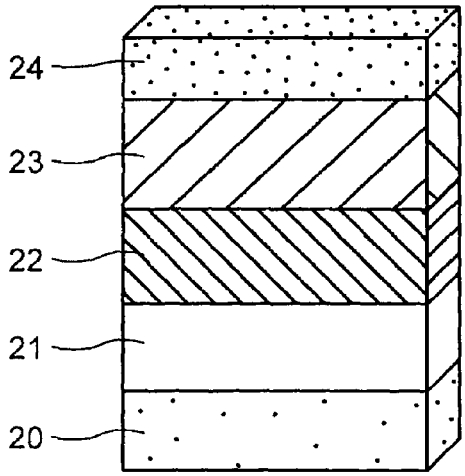
FIG. 2 is a partially enlarged diagram of an image carrier included in the image forming apparatus shown in FIG. 1.

The image carrier 10 used in this embodiment is an organic image carrier of a negative electrification characteristic having an improved abrasion resistance property. A photosensitive layer or the like is provided on a drum-shaped conductive support member with a diameter of 30 millimeters. A partial sectional view of the image carrier 10 is shown in FIG. 2. An undercoat layer 21 serving as an insulating layer is provided on a conductive support member 20 serving as a base layer. A charge generating layer (CGL) 22 serving as a photosensitive layer and a charge transport layer (CTL) 23 are provided on the undercoat layer 21. A protective layer (FR) 24 constituting a surface of the image carrier 10 is stacked on the charge transport layer 23.

It is possible to use a member having electrical conductivity with volume resistance of $10^{10}$ Ω·cm or less as the conductive support member 20. For example, it is possible to use a member obtained by coating metal such as aluminum, nickel, chrome, nichrome, copper, gold, silver, or platinum or a metal oxide such as tin oxide or indium oxide, applied over plastics or paper of a film shape or a cylindrical shape, by vapor deposition or sputtering. Alternatively, it is possible to use a plate of aluminum, an aluminum alloy, nickel, or stainless steel, a pipe obtained by forming an element tube from the plate according to a method such as extrusion or drawing and then subjecting the element tube to surface treatment such as machining, super finishing, or grinding, or the like. It is also possible to use an endless nickel belt and an endless stainless steel belt disclosed in Japanese Patent Application Laid-Open No. S52-36016 as the conductive support member 20.

Besides, it is possible to use the support member constituted as described above further coated with conductive powder dispersed in appropriate binding resin as the conductive support member 20. Examples of the conductive powder include carbon black, acetylene black, metal powder of aluminum, nickel, iron, nichrome, copper, zinc, and silver, and metal oxide powder of conductive tin oxide and ITO. Examples of the binding resin used simultaneously include a thermoplastic resin, a thermosetting resin, and a photo-setting resin such as polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyallylate resin, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenolic resin, and alkyd resin. It is possible to provide such a conductive layer by dispersing the conductive powder and the binding resin in an appropriate solvent such as tetrahydrofuran, dichloromethane, methyl ethyl ketone, or toluene and applying the conductive powder and the binding resin.

It is also possible to satisfactorily use an appropriate cylindrical substrate having a conductive layer provided thereon by a heat-shrinkable tubing obtained by mixing the conductive powder in a material such as polyvinyl chloride, polypropylene, polystyrene, polyvinylidene chloride, polyethylene, chlorinated rubber, or Teflon (registered trademark) as the conductive support member 20.

A photosensitive layer can be a single layer or a stacked layer. However, for convenience of explanation, a stacked layer constitution including the charge generating layer 22 and the charge transport layer 23 is explained first.

The charge generating layer 22 is a layer containing a charge generating substance as a main component. It is possible to use a publicly-known charge generating substance for the charge generating layer 22. Representative examples of the charge generating substance include a monoazo pigment, a disazo pigment, a trisazo pigment, a perylene pigment, a perinone pigment, a quinacridone pigment, a quinine condensed polycyclic compound, a squaric acid pigment, other phthalocyanine pigments, a naphthalocyanine pigment, an azlenium salt dye. These charge generating substances are used usefully. It is possible to use the charge generating substances independently or in a mixed state.

The charge generating layer 22 is formed by dispersing the charge generating substance in an appropriate solvent together with the biding resin as required using a ball mill, an attritor, a sand mill, ultrasonic waves, or the like, applying the charge generating substance on the conductive support member 20 or the undercoat layer 21, and drying the charge generating substance.

It is possible to disperse, in the charge generating layer 22, the charge generating substance in the binding resin as required. Examples of the binding resin that can be used include polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinyl carbazole, polyacrylamide, polyvinyl benzale, polyester, a phenoxy resin, vinyl chloride-vinyl acetate copolymer, polyvinyl acetate, polyphenylene oxide, polyamide, polyvinyl pyridine, a cellulose resin, casein, polyvinyl alcohol, and polyvinylpyrrolidone. An amount of the binding resin is appropriately 0 to 500 parts by weight, preferably, 10 to 300 parts by weight with respect to 100 parts by weight of the charge generating substance. The binding resin can be added before dispersion or after dispersion.

Examples of the solvent used here include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. In particular, a ketone solvent, an ester solvent, and an ether solvent are used satisfactorily. These solvents can be used independently or in a mixed state.

The charge generating layer 22 contains the charge generating substance, the solvent, and the binding resin as main components. However, the charge generating layer 22 can contain any additive such as a sensitizer, a dispersant, a surface active agent, or silicone oil.

As a method of coating a coating liquid, it is possible to use a method such as an immersion coating method, spray coating, beat coating, nozzle coating, spinner coating, or ring coating. Thickness of the charge generating layer 22 is appropriately about 0.01 micrometer to 5 micrometers, preferably, 0.1 micrometer to 2 micrometers.

It is possible to form the charge transport layer 23 by solving or dispersing a charge transport substance and a binding resin in an appropriate solvent, coating the charge transport substance and the binding resin on the charge generating layer 22, and drying the charge transport substance and the binding resin. It is also possible to add a single or two or more kinds of plasticizers, leveling agents, anti-oxidizing agents, or the like as required.

There are a hole transport substance and an electron transport substance as the charge transport substance.

Examples of the electron transport substance include electron receptive substances such as chloroanyl, bromanyl, tetracyano ethylene, tetracyano quinodimethane, 2,4,7-trinitro-9-fluorenone, 2,4,5,7-tetranitro-9-flulorenone, 2,4,5,7-tetranitro xanthone, 2,4,8-trinitro thioxanthone, 2,6,8-trinitro-4H-indeno[1,2-b]thiophene-4-on, 1,3,7-trinitro dibenzothiophene-5,5-dioxide, and benzoquinone.

Examples of the hole transport substance include other publicly-known materials such as poly-N-vinylcarbazole and a derivative thereof, poly-γ-carbazole ethyl glutamate and a derivative thereof, a pyrene-formaldehyde condensate and a derivative thereof, polyvinyl pyrene, polyvinyl phenanthrene, polysilane, an oxazole derivative, an oxiadiazole derivative, an imidazole derivative, a monoarylamine derivative, a diarylamine derivative, a triarylamine derivative, a stilbene derivative, an α-phenyle stilbene derivative, a benzidine derivative, a diarylmethane derivative, a triaryulmethane derivative, a 9-styryl anthracene derivative, a pyrazoline derivative, a dibinylbenzen derivative, a hydrazone derivative, an indene derivative, a butadiene derivative, a pyrene derivative, a bisstilbene derivative, an enamine derivative. These charge transport substances are used independently or in a mixed state.

Examples of the binding resin include thermoplastic resin or thermosetting resin such as polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyallylate resin, phenoxy resin, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenolic resin, and alkyd resin.

An amount of the charge transport substance is appropriately 20 to 300 parts by weight, preferably, 40 to 150 parts by weight with respect to 100 parts by weight of the binding resin. Thickness of the charge transport layer 23 is preferably set to 25 micrometers or less in terms of resolution and responsiveness. A lower limit value thereof is preferably 5 micrometers or more, although the lower limit value varies depending on a system to be used (in particular, a charge potential, etc.).

As the solvent used here, tetrahydrofuran, dioxane, toluene, dichloromethane, monochlorobenzene, dichloroethane, cyclohexanone, methyl ethyl ketone, acetone, and the like are used. These solvents can be used independently or in a mixed state.

The single layer constitution of the photosensitive layer is described below. It is possible to form the photosensitive layer by solving or dispersing the charge transport substance, the charge transport substance, the binding resin, and the like in an appropriate solvent, coating the charge transport substance, the charge transport substance, the binding resin, and the like over the conductive support member 50 or the undercoat layer 51, and drying the charge transport substance, the charge transport substance, the binding resin, and the like. The photosensitive layer can be formed of the charge generating substance and the binding substance without mixing the charge transport substance. It is also possible to add a plasticizer, a leveling agent, an anti-oxidizing agent, or the like as required.

As the binding resin, other than the examples of the binding resin used in the charge transport layer 23, the examples of the binding resin used in the charge generating layer can be mixed and used. It goes without saying that it is also possible to satisfactorily use the polymeric charge transport substance described above. An amount of the charge generating substance is preferably 5 to 40 parts by weight, an amount of the charge transport substance is preferably 0 to 190 parts by weight and more preferably 50 to 150 parts by weight with respect to 100 parts by weight of the binding resin.

It is possible to form the photosensitive layer by coating a coating liquid obtained by dispersing tetrahydrofuran, dioxane, dichloroethane, cyclohexane, or the like together with the binding resin and the charge transport substance according to the immersion coating method, spray coating, beat coating, or ring coating. Thickness of the photosensitive layer is appropriately about 5 to 25 micrometers.

In the image carrier 10 of the example shown in the figure, it is possible to provide the undercoat layer 21 between the conductive support member 20 and the photosensitive layer. In general, the undercoat layer 21 contains resin as a main component. However, considering the fact that the photosensitive layer is coated over the resin with a solvent, it is desirable that the resin has high solvent resistance against a general organic solvent. Examples of the resin include water soluble resin such as polyvinyl alcohol, casein, and polyacrylic sodium, alcohol soluble resin such as copolymer nylon and methoxymethyl nylon, and curing type resin forming a three-dimensional network structure such as polyurethane, melamine resin, phenolic resin, alkyd-melamine resin, and epoxy resin. A fine powdery pigment of a metal oxide, which can be exemplified by titanium oxide, silica, alumina, zirconium oxide, tin oxide, and indium oxide, can be added to the undercoat layer 21 for prevention of moiré, a reduction in a residual potential, and the like. It is possible to form the undercoat layer 21 using an appropriate solvent and coating method in the same manner as the formation of the photosensitive layer. It is also possible to use a silane coupling agent, a titanium coupling agent, a chrome coupling agent, or the like as the undercoat layer 21 in the example shown in the figure. Besides, as the undercoat layer 21, it is also possible to satisfactorily use a layer provided with $Al_2O_3$ by anodic oxidation or a layer provided with an organic matter such as polyparaxylylene (parylene) or an inorganic matter such as $SiO_2$, $SnO_2$, $TiO_2$, ITO, or $CeO_2$ by the vacuum thin-film forming method. Besides, it is possible to use publicly-known layers. Thickness of the undercoat layer 2 is appropriately 0 to 5 micrometers.

It is also possible to provide a protective layer 24 on an uppermost layer of the image carrier 10 to prevent mechanical abrasion. For example, it is possible to use an image carrier, a surface of which is coated with amorphous silicon to improve abrasion resistance, an organic image carrier further provided with an uppermost layer dispersed with alumina, tin oxide, or the like on a surface of the charge transport layer 23, and the like. It is advisable to provide the protective layer 24 containing inorganic particulates.

As explained above, a constitution of the image carrier 10, which can be used in this example of the protective layer 24, is not limited to a specific constitution. It is possible to apply the present invention to image carriers having various layer constitutions. Examples of the layer constitutions include a one-layer constitution in which only a photosensitive layer containing the charge generating substance and the charge transport substance as main components is provided on the conductive support member 20, a constitution in which the charge generating layer containing the charge generating substance as a main component and the charge transport layer containing the charge transport substance as a main component are stacked on the conductive support member 20, a constitution in which a photosensitive layer containing the charge generating substance and the charge transport substance is provided on the conductive support member 20 and a protective layer is provided on the photosensitive layer, a constitution in which a charge generating layer containing the charge generating substance as a main component and a charge transport layer containing the charge transport substance as a main component are stacked on the conductive support member and a protective layer is provided on the charge transport layer, and a constitution in which a charge transport layer containing the charge transport substance as a main component and a charge generating layer containing the charge generating substance as a main component are stacked on the conductive support member and a protective layer is provided on the charge generating layer.

A protective layer containing binder resin having a crosslinked structure is also effectively used as the protective layer 24. Concerning formation of the crosslinked structure, a reactive monomer having plural crosslinking functional groups in one molecule is used and crosslinking reaction is caused using light and heat energy to form a three-dimensional network structure. The network structure functions as binder resin to show high abrasion resistance.

From the viewpoint of electrical safety, wear resistance, and durable life, it is extremely effective to use monomer having a charge transport ability in all or a part thereof as the reactive monomer. A charge transport portion is formed in the network structure by using such monomer. This makes it possible for the protective layer to sufficiently show a function as the protective layer 24.

Examples of the reactive monomer having the charge transport ability include a compound containing at least one charge transporting component and at least one silicon atom having a hydrolytic substituent in an identical molecule, a compound containing a charge transporting component and a hydroxyl group in an identical molecule, a compound containing a charge transporting component and a carboxyl group in an identical molecule, a compound containing a charge transporting component and an epoxy group in an identical molecule, and a compound containing a charge transporting component and an isocyanate group in an identical molecule. The charge transporting materials having reactive groups can be used independently or in combination.

Preferably, reactive monomer having a triarylamine structure is effectively used as the monomer having the charge transport ability because, for example, the reactive monomer has high electrical and chemical stability and mobility of carriers is high.

Besides, it is possible to use both monofunctional and bifunctional polymerizable monomers and polymerizable oligomers for the purpose of giving functions such as adjustment of viscosity at the time of coating, relaxation of stress of the crosslinking charge transport layer, a reduction in surface energy, and a reduction of the number of coefficients of friction. It is possible to use publicly-known polymerizable monomers and oligomers as these polymerizable monomers and oligomers.

In the example shown in the figure, polymerization and crosslinking of the hold transporting compound are performed using heat or light. In performing a polymerization reaction using heat, the polymerization reaction progresses only with heat energy in some cases and a polymerization initiator is required in other cases. It is preferable to add the initiator to advance the reaction efficiently at lower temperature.

In polymerizing the hole transporting compound using light, it is preferable to use an ultraviolet ray as light. It is extremely rare that the reaction progresses only with light energy. In general, a light polymerization initiator is used with the light energy. The polymerization initiator in this case is a polymerization initiator that mainly absorbs ultraviolet rays with a wavelength of 400 nanometers or less and generates active species such as radicals and ions to start polymerization. Note that, in this example, it is also possible to use both heat and the light polymerization initiator.

The charge transport layer 23 having the network structure formed in this way has high abrasion resistance but has large volume shrinkage at the time of crosslinking. When thickness of the charge transport layer 23 is increased excessively, a crack or the like can be caused. In such a case, it is also possible that a stacked layer is used as the protective layer, a protective layer of low-molecular polymer is used in a lower layer (on the photosensitive layer side), and a protective layer having the crosslinked structure is formed in an upper layer (on the surface side).

For example, an electrophotographic image carrier A is formed in the same manner as described above except that the protective layer coating liquid, the film thickness, and the film forming conditions are changed as described below.

182 parts by weight of methyl trimethoxysilane, 40 parts by weight of dihydroxy methyl triphenylamine, 225 parts by weight of isopropanol, 106 parts by weight of 2% acetate, and 1 parts by weight of aluminum trisacetyleacetonate are mixed to prepare a coating liquid for a protective layer. The coating liquid is coated on the charge transport layer 23 and dried and subjected to heat curing at 100° C. for one hour to form the protective layer 24 with thickness of 3 micrometers.

An electrophotographic image carrier B is formed in the same manner as described above except that the protective layer coating liquid, the film thickness, and the film forming conditions are changed as described below.

30 parts by weight of a hole transporting compound (represented by a structural formula of Formula 1 below) and 0.6 parts by weight of acrylic monomer (represented by a structural formula of Formula 2 below) and a light polymerization initiator (1-hydroxy-cyclohexyl-phenyl-ketone) are solved in a mixed solvent with 50 parts by weight of monochlorobenzene and 50 parts by weight of dichloromethane to prepare a coating for surface protection. The coating is coated on the charge transport layer 23 by the spray coating method and cured for thirty seconds at light intensity of 500 mW/cm$^2$ using a metal halide lamp to form the surface protective layer 24 with thickness of 5 micrometers.

[Formula 1]

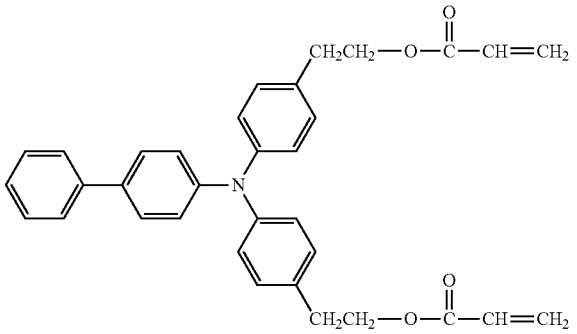

-continued

[Formula 2]

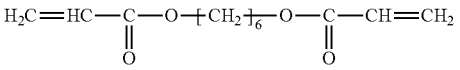

An example of a constitution of the charging device 11 used in the example shown in the figure is described below.

Conventionally, there is a charging device using a corona charging system utilizing corona discharge. In the corona discharge system, a charge wire is disposed near a member to be charged, a high voltage is applied to the charge wire to cause corona discharge between the charge wire and the member to be charged, and the member to be charged is charged by the corona discharge. However, in the case of the corona charging system, discharge products such as ozone and nitrogen oxide (NOx) are generated according to the corona discharge. It is likely that the discharge products form a film of nitric acid or nitrate that adversely affects an image carrier at the time of image formation. Thus, it is desirable to prevent the generation of the discharge products if possible.

Thus, in recent years, a contact charging system or a proximity charging system, with which generation of the discharge products is less and charging is possible at low power, has been actively developed instead of the corona charging system. In these systems, a charging member such as a roller, a brush, or a blade is opposed to a member to be charged such as an image carrier in contact with or near the member to be charged. A voltage is applied to the charging member to charge a surface of the member to be charged. Usability of this system is high because generation of the discharge products is less and it is possible to realize a reduction in power compared with the corona discharge system. Since a large-scale charging device is not required, it is possible to reduce a size of an image forming apparatus. Thus, the systems meet the need for the reduction in a size of an image forming apparatus.

In the example shown in the figure, a non-contact roller charging system described below is used as an example for attaining reduction in power, reduction of hazards, and reduction in size.

When the spherical toner is used, as described above, cleaning failure tends to occur compared with the conventional grinded toner. In an image forming apparatus that makes it possible to perform cleaning of the spherical toner using a deposit layer formed of an amorphous toner, when cleaning failure occurs, if a non-contact roller charging system is used, a toner remaining due to cleaning failure is never deposited on the charging device. Thus, there is an advantage that an abnormal image due to charging abnormality is not formed.

The charging device according to the example shown in the figure charges the image carrier 10 according to AC applied discharge by a charging member arranged to be opposed to the image carrier 10 near and in non-contact with the image carrier 10. Note that there is a method of charging the image carrier 10 according to AC applied discharge by a charging member arranged to be opposed to an image carrier in contact with the image carrier. When the method is applied, it is preferable to use an elastic member that improves contactability between a surface of the image carrier 10 and the charging member and does not apply mechanical stress on the image carrier 10. However, when the elastic member is used, it is likely that a charging nip width is increased and protective substances tend to be deposited on the charging roller side because of the increase in the charging nip width. Thus, it is more advantageous for improvement of durability of the member to be charged that the image carrier 10 is charged by the non-contact charging system.

Figure 3:
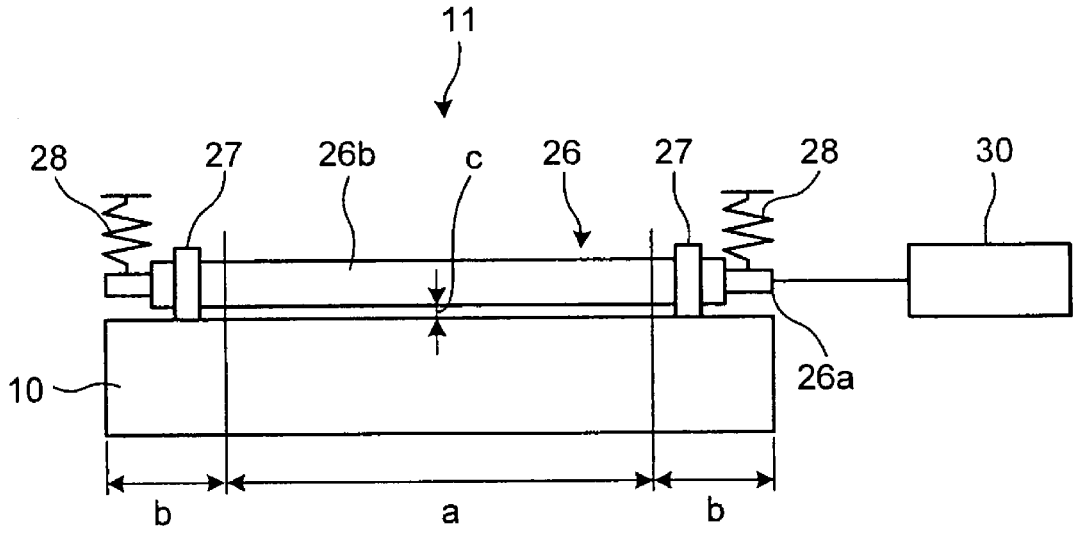
FIG. 3 is a diagram of a positional relation between the image carrier and a charging device shown in FIG. 1.

A positional relation between the image carrier 10 and the charging device 11 in the charging position is shown in FIG. 3. The charging device 11 includes a charging roller 26 serving as a charging member, a spacer 27, a spring 28, and a power supply 30. The charging roller 26 includes a shaft section 26*a* and roller section 26*b* serving as a charging section. The roller section 26*b* is opposed to the image carrier 10 and has a function of charging the surface of the image carrier 10. The roller section 26*b* is capable of rotating according to rotation of the shaft section 26*a*. The spacer 27 serving as a gap holding member is provided in the charging roller 26 such that the roller section 26*b* of the charging roller 26 is arranged to be opposed to the surface of the image carrier 10 with a fine gap "c" between the roller section 26*b* and the surface of the image carrier 10. With this spacer 27, a portion of the charging roller 26 opposed to an image forming area "a" of the surface of the image carrier 10 where an image is formed is disposed to be in non-contact with the image carrier 10. A dimension in a longitudinal direction of the roller section 26*a* is set longer than the image forming area of the image carrier 10. The fine gap "c" is formed by bringing the spacer 27 into abutment against a non-image-forming area "b" of the image carrier 10. The charging roller 26 rotates via the spacer 27 following the surface of the image carrier 10. The fine gap "c" is formed such that a distance between the charging roller section 26*b* and the image carrier 10 is 1 micrometer to 100 micrometers in a portion where the charging roller section 26*b* and the image carrier 10 are closest to each other. The distance is preferably 30 micrometers to 65 micrometers.

The spring 28 for pressing the charging roller 26*a* toward the member to be charged is attached to the shaft section 26*a*. This makes it possible to maintain the fine gap "c" accurately.

A power supply 30 for charging is connected to the charging roller 26. The power supply 30 causes the surface of the image carrier 10 uniformly with AD applied discharge in a fine gap between the surface of the image carrier 10 and the surface of the charging roller 26. In this example, an alternating voltage in which an AC voltage serving as an AC component is superimposed on a DC voltage serving as a DC component is applied to the charging roller 26. Influences such as fluctuation in a charging potential due to fluctuation in a fine gap are controlled by using the alternating voltage. This makes it possible to perform uniform charging.

The charging roller 26 includes a core bar serving as a conductive support member assuming a cylindrical shape and a resistance adjusting layer formed on an outer peripheral surface of the core bar. In this example, a diameter of the charging roller 26 is set to 10 millimeters.

It is possible to use a known material such as a rubber member for the surface of the charging roller 26. However, it is preferable to form the surface of the charging roller 26 with a resin material. This is because, when the rubber member is used, it is difficult to maintain the fine gap between the surface of the charging roller 26 and the image carrier 10 because of water absorption of rubber and occurrence of bending. It is likely that only the center of the charging roller 26 unexpectedly comes into contact with the surface of the image carrier 10 depending on an image forming condition. It is difficult to cope with turbulence of the surface layer of the image carrier 10 due to such local and unexpected contact of the charging roller 26 with the image carrier 10. Therefore, when the image carrier 10 is charged by the non-contact charging system, it is preferable to use a hard material that can maintain a fine gap between a charging roller and an image carrier uniform.

It is possible to use, for example, a material formed as described below as the hard material for the surface of the charging roller 26. The resistance adjusting layer is formed with a thermosetting resin composition (polyethylene, polypropylene, polymethyl methacrylate, polystyrene, a copolymer of the foregoing, etc.) in which a high-molecular ion conductive agent is dispersed. The surface of the resistance adjusting layer is subjected to hardening film coating with a hardening agent. It is possible to perform the hardening film coating by, for example, impregnating the resistance adjusting layer in a treatment solution containing a compound containing isocyanate. Alternatively, a hardening treatment film layer can be formed on the surface of the resistance adjusting layer anew.

As shown in FIG. 1, the developing device 13 includes, in a development case 32, for example, an agitating and conveying member 33 that agitates and conveys a developer, a developer supply roller 34 that supplies the developer conveyed by the agitating and conveying member 33, a developing roller 35 that deposits a toner of the developer supplied by the developer supply roller 34 on the image carrier 10, and a laminating member (not shown) that laminates the developer on the developing roller 35 before being deposited on the image carrier 10.

In recent years, there is an increasing need for high resolution to form a higher definition image more accurately in an image forming apparatus for performing image formation using a toner. As a method of attaining high resolution, it is known that it is effective to use a spherical toner with nearly spherical toner particles having a small diameter. Thus, the developing device 13 uses a spherical toner with circularity of 0.95 or more to improve an image quality.

Figure 4A:
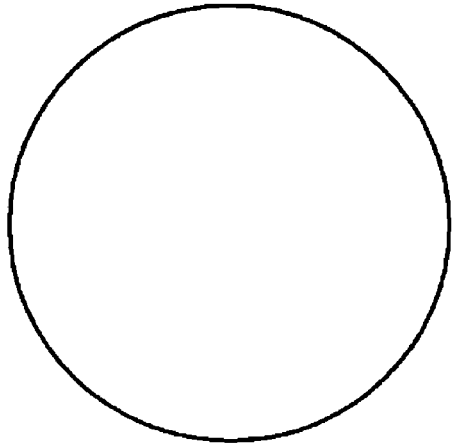
FIG. 4A is a diagram of a projected shape of a toner particle.
Figure 4B:
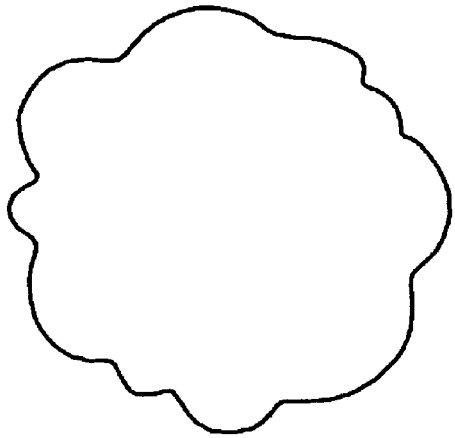
FIG. 4B is a diagram of a complete round having the same area as the projected shape.

The "circularity" in this context is average circularity measured by a flow-type particle image analyzer FPIA-2000 (a product of Toa Medical Electronics). Specifically, 0.1 milliliter to 0.5 milliliters of a surface active agent, preferably, alkylbenzene sulfonic acid is added to 100 milliliters to 150 milliliters of water, from which impure solid matters are removed in advance, in a container as a dispersant and about 0.1 to 0.5 gram of a measurement sample (a toner) is further added. Thereafter, a suspension in which the toner is dispersed is subjected to dispersion treatment for about one to three minutes with an ultrasonic disperser to adjust a dispersion concentration to 3,000/micro-liter to 10,000/micro-liter. The suspension is set in the analyzer to measure a shape and distribution of the toner. On the basis of a result of the measurement, when an outer peripheral length of an actual toner projection shape shown in FIG. 4A is L1, a projection area is S, and an outer peripheral length of a complete round shown in FIG. 4B having the same projection area S is L2, L2/L1 is calculated and an average of L2/L1 is set as the circularity.

As the spherical toner, it is possible to use a toner with toner particles made spherical by subjecting an irregular-shaped toner (a ground toner) having irregular shaped toner particles is subjected to heating treatment or the like according to the grinding method widely used conventionally or a toner manufactured by the polymerization method.

Figure 5:
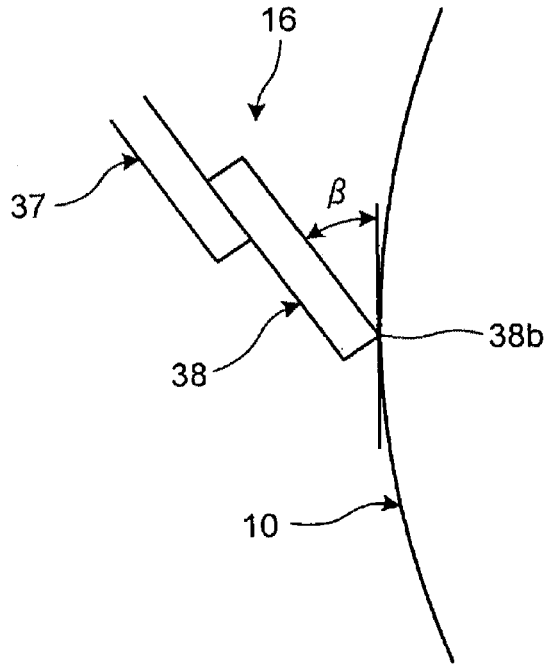
FIG. 5 is an enlarged diagram of the cleaning device shown in FIG. 1.
Figure 6:
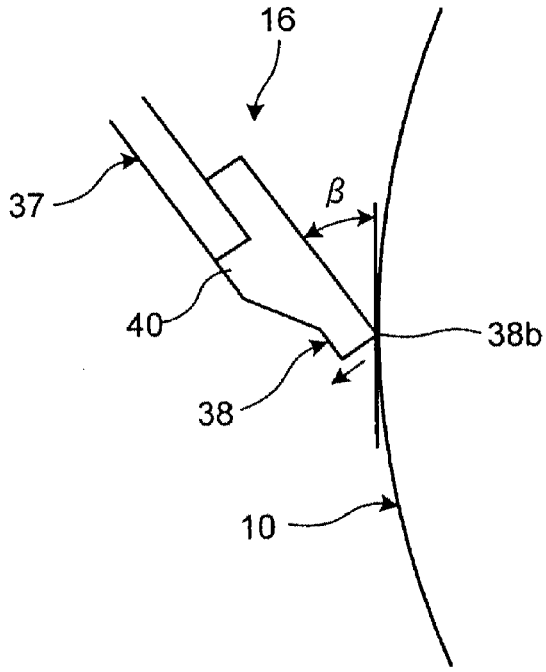
FIG. 6 is an enlarged diagram of another example of the cleaning device.

The cleaning device 16 is formed by, for example, as shown in FIG. 5, sticking a base end of an elastic cleaning blade 38 to one side of a tabular support member 37 serving as a so-called blade holder and pressing a tip ridge portion 38*b* against the peripheral surface of the image carrier 10. For example, rubber with the JISA hardness of 60 degrees to 80 degrees and rebound resilience of 30 percent or less at 23° C. is used as the cleaning blade 38. The cleaning blade 38 is formed in a tabular shape elongated in the axial direction of the image carrier 10. A shape of the cleaning blade 38 is not limited to such a shape. For example, as shown in FIG. 6, the cleaning blade 38 can have a shape having a window 40 that, when a tip of the support member 37 is fit in and stuck on a base end step portion of the cleaning blade 38 and the tip ridge portion 38*b* is pressed against the image carrier 10, comes into abutment against the support member 37 to prevent the cleaning blade 38 from bending in an arrow direction.

Figure 7A:
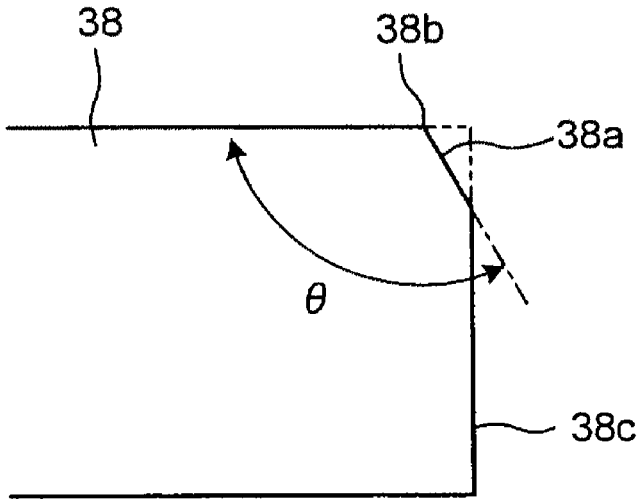
FIG. 7A is an enlarged diagram of a tip of a cleaning blade with a part of the tip surface cut.
Figure 7B:
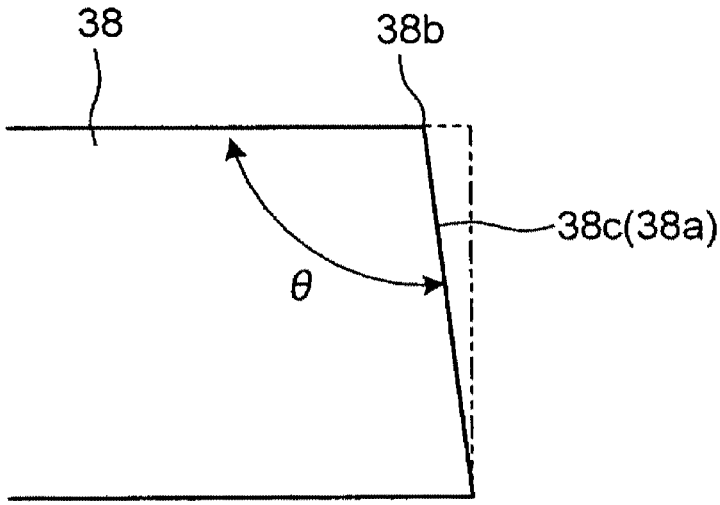
FIG. 7B is an enlarged diagram of a tip of the cleaning blade with the entire tip surface cut.

For example, as shown in FIG. 7A, a cut surface 38*a* is provided by obliquely cutting a part of a tip surface 38*c* to set an angle θ forming the tip ridge portion 38*b* of the cleaning blade 38 as an obtuse angle. As shown in FIG. 7B, the entire tip surface 38*c* can be formed as the cut surface 38*a* by obliquely cutting the entire tip surface 38*c* to set the angle θ forming the tip ridge portion 38*b* as an obtuse angle. The obtuse angle is preferably in a range of 95 to 140 degrees. The tip ridge portion 38*b* of the cleaning blade 38 is pressed against the image carrier 10 at a surface pressure of 2.0 MPa or more, desirably 3.0 MPa or more.

A surface pressure necessary for cleaning the spherical toner is described in detail below. The surface pressure is calculated by dividing a total load applied in pressing the cleaning blade 38 against the image carrier 10 by a contact area of the cleaning blade 38 and the image carrier 10. It is possible to easily calculate the contact area of the cleaning blade 38 and the image carrier 10 by measuring a contact area at the time when the cleaning blade 38 is pressed against a transparent dummy image carrier.

In an experiment described below, a result of the experiment indicates that cleaning performance is different depending on a difference of a surface pressure when an identical load (linear pressure) is applied. Specifically, when a fixed load (linear pressure) was applied to the cleaning blade 38, the contact area was changed, a surface pressure in that case was calculated, and a relation between the surface pressure and the cleaning performance was checked.

Table 1 below shows a result obtained by calculating, when a certain load was applied to a cleaning blade, a contact area of the cleaning blade and an image carrier from observation to calculate a surface pressure. Specifically, since a length in a main scanning direction in which the cleaning blade came into contact with the image carrier was known, a contact width of the image carrier and the cleaning blade was calculated from an observation image and a linear pressure [g/cm] was divided by the contact width to calculate the surface pressure.

Cleaning performance described in Table 1 was judged based on an amount of residual toner on the surface of the image carrier after cleaning. Sign (A) in the table indicates that the residual toner is cleaned completely, sign (B) indicates that the toner remains, sign (C) indicates that streak-like cleaning failure partially occurs or a slight amount of toner remains on the entire surface, and sign (D) indicates that a streak-like or a large amount of toner remains on the entire surface.

TABLE 1

| Linear pressure [N/cm] | Contact length [μm] | Surface pressure [MPa] | Cleaning performance |
|---|---|---|---|
| 1.20 | 5 | 24.00 | (C) |
| 1.20 | 10 | 12.00 | (B) |
| 1.20 | 20 | 6.00 | (A) |
| 1.20 | 30 | 4.00 | (A) |
| 1.20 | 50 | 2.40 | (B) |
| 1.20 | 60 | 2.00 | (B) |
| 0.95 | 5 | 19.00 | (C) |
| 0.95 | 10 | 9.50 | (B) |
| 0.95 | 20 | 4.75 | (A) |
| 0.95 | 30 | 3.17 | (A) |
| 0.95 | 50 | 1.90 | (D) |
| 0.95 | 60 | 1.58 | (D) |
| 0.95 | 90 | 1.06 | (D) |
| 0.40 | 5 | 8.00 | (C) |
| 0.40 | 10 | 4.00 | (B) |
| 0.40 | 20 | 2.00 | (B) |
| 0.40 | 30 | 1.33 | (D) |
| 0.40 | 40 | 1.00 | (D) |
| 0.40 | 50 | 0.80 | (D) |
| 0.20 | 5 | 4.00 | (C) |
| 0.20 | 10 | 2.00 | (C) |
| 0.20 | 20 | 1.00 | (D) |

In the experiment, the linear pressure was varied between 0.2 N/cm and 1.2 N/cm and the contact width was varied between 5 micrometers and 90 micrometers. When the linear pressure of 1.2 N/cm was applied to the cleaning blade, satisfactory cleaning performance ((A) or (B)) was obtained at the surface pressure of 2.4 MPa to 12.0 MPa. Conversely, at the surface pressure of 2.4 MPa, cleaning failure occurred. It is considered that this is because, since the contact width is as narrow as 5 micrometers, abutment unevenness occurs in the main scanning direction because of accuracy of the image carrier or the like and a sufficient surface pressure is not applied partially. When the linear pressure of 0.95 N/cm was applied to the cleaning blade, satisfactory cleaning performance was obtained at the surface pressure of 3.17 MPa to 9.50 MPa. However, at the surface pressure of 1.9 MPa, since the contact width is as narrow as 5 micrometers, cleaning failure also occurred because of abutment unevenness. At the surface pressure of 1.9 MPa or less, cleaning failure occurred.

When the linear pressure was 0.4 N/cm, satisfactory cleaning performance was obtained at the surface pressure of 2.0 MPa to 4.0 MPa. However, at the surface pressure of 8.0 MPa (abutment unevenness) and at the surface pressure of 1.33 MPa or less, cleaning failure occurred.

The above result say that, since a load per a unit area, that is, the surface pressure [MPa] varies depending on a contact state (a contact area) between the cleaning blade and the image carrier even if the same linear pressure is applied, it is impossible to clean the spherical toner when the surface pressure is low even if the linear pressure is set high.

Judging from the result shown in Table 1, it is possible to clean the spherical toner by setting the surface pressure to 2.0 MPa or more. However, when the contact width is about 10 micrometers or the surface pressure is about 2.0 MPa, a slight amount of toner remains ((B)) and complete cleaning is not realized. This is because, although it is possible to add a higher surface pressure as the contact area is reduced, when the contact width of the cleaning blade and the image carrier is too small, cleaning failure tends to be caused by unevenness of contact with the image carrier, scratches on the surface of the image carrier, projections, and the like. To clean the spherical toner, as shown in the examples in FIGS. 5 and 6, it is desirable to set the surface pressure to 2.0 MPa or more, preferably, 3.0 MPa or more and set the contact width to 10 micrometers or more.

As described above, to clean the spherical toner, it is necessary to set the contact width of the cleaning blade and the image carrier to 10 micrometers or more, and set the surface pressure to 2.0 MPa or more, desirably, 3.0 MPa or more. To control film-shaving of the image carrier, an increase in a driving torque of the image carrier, blade abrasion, and the like, it is desirable to set the contact width to 10 micrometers or more and 40 micrometers or less, preferably, 30 micrometers or less. This is because, even when the contact width of the cleaning blade and the image carrier is set extremely large (e.g., 100 micrometers), if the surface pressure is 2.0 MPa or more or 3.0 MPa or more, it is possible to prevent the spherical toner from slipping into under the cleaning blade, so as to clean the spherical toner. However, for example, when the contact width is 100 micrometers, to set the surface pressure to 2.0 MPa, the linear pressure of 2.0 N/cm has to be applied. Thus, an extremely large linear pressure is required. To clean the spherical toner, it is necessary to set the contact area of the cleaning blade and the image carrier as small as possible and apply a high surface pressure at a smallest linear pressure. To prevent the spherical toner from slipping into under the cleaning blade, even if accuracy of the image carrier and a toner particle diameter are taken into account, it is preferable to set the contact width of the image carrier and the cleaning blade to 10 micrometers or more. However, it is possible to set a linear pressure, which is applied to set the surface pressure to 2.0 MPa or more or 3.0 MPa or more, between 0.2 N/cm and 1.2 N/cm. The linear pressure is preferably set to 0.9 N/cm or less.

It is possible to apply a surface pressure for preventing the spherical toner from slipping into under the cleaning blade with a low linear pressure by setting the tip of the cleaning blade 38 as an obtuse angle compared with the time when the blade tip is 90 degrees. This is explained below.

As described above, to clean the spherical toner, it is necessary to bring the cleaning blade into abutment against the image carrier at the surface pressure of 2.0 MPa or more. Even when the same surface pressure is applied, a load (a linear pressure) applied to the entire cleaning blade varies depending on a blade shape. Since the linear pressure significantly affects a magnitude of a driving torque of the image carrier, a durable life of the image carrier 10, and abrasion of the cleaning blade 38, it is desirable to set the linear pressure as low as possible.

To clean the spherical toner, a linear pressure, which is large compared with the linear pressure necessary for cleaning the conventional ground toner, only has to be applied. Thus, taking into account a material of the cleaning blade, the blade shape that can eliminate buckling of the cleaning blade at the tip of the support member and add a high linear pressure is examined above.

However, as described above, it is seen that the toner removal performance depends on a surface pressure rather than a linear pressure. Thus, the blade shape that can apply the surface pressure of 2.0 MPa necessary for cleaning the spherical toner at a lower linear pressure is examined above. As a result, it is made clear that, by processing the tip ridge portion 38*b* of the cleaning blade 38 pressed against the image carrier 10 into an obtuse angle, it is possible to apply a surface pressure capable of cleaning the spherical toner at a low linear pressure compared with the time when the tip ridge portion 38*b* is set to 90 degrees. In other words, by processing the tip ridge portion 38*b* into an obtuse angle, when an identical load is applied, the possibility of curling of a blade cut surface is reduced and the contact area is reduced compared to when the tip ridge portion 38*b* is 90 degrees. Thus, it is possible to apply a high reaction per unit area, that is, a high surface pressure.

A relation between a linear pressure and a contact width and a relation between a linear pressure and a surface pressure are explained below concerning three types of cleaning blades. The cleaning blades are a cleaning blade A having a tip reaction concentration shape shown in FIG. 8A, an obtuse angle cleaning blade B having the tip reaction concentration shape shown in FIG. 8B, which is the same as the one shown in FIG. 6, in which a tip ridge portion in contact with an image carrier is cut into an obtuse angle, and a cleaning blade C for the conventional ground toner shown in FIG. 8C.

The cleaning blade C is stuck to one side of the support member 37. The cleaning blade C has thickness of 2 millimeters, a free length from the tip of the support member 37 to the blade tip of 7 millimeters, and the JISA hardness of 70 degrees.

Figure 8A:
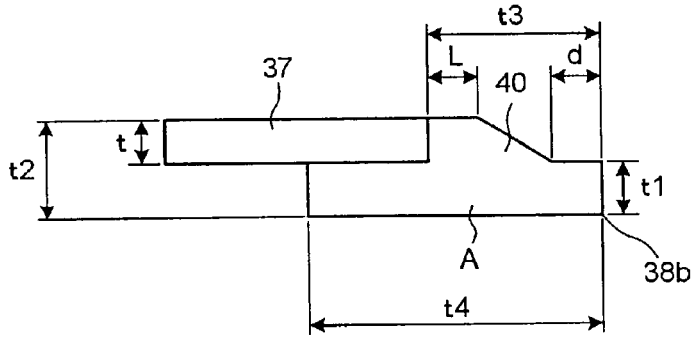
FIG. 8A is a diagram of support for a cleaning blade A in a comparative example.
Figure 8B:
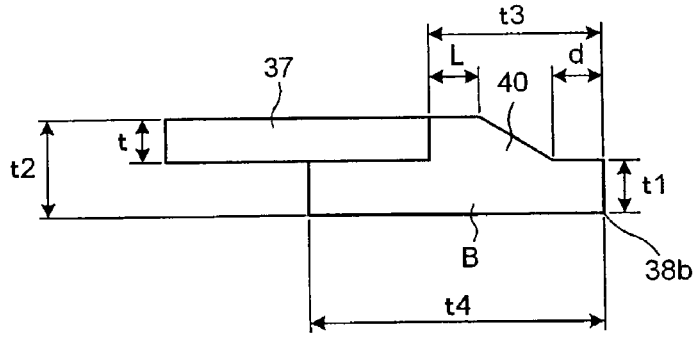
FIG. 8B is a diagram of support for a cleaning blade B according to the present invention.

The cleaning blade A and the cleaning blade B are formed in a common shape. To efficiently apply a high surface pressure to the blade tip, trunk abutment causing a fall in the surface pressure is prevented. In other words, as shown in FIGS. 8A and 8B, both the cleaning blade A and the cleaning blade B are closely in contact with the support member 37. A projection 40 is formed in the cleaning blade A and the cleaning blade B. The projection 40 comes into abutment against the support member 37 when the tip ridge portion 38*b* is pressed against the image carrier and prevents the cleaning blade from escaping. The cleaning blade A and the cleaning blade B are formed of a thick portion substantially in the center and thin portions at both ends to have generally a projected shape. A step portion formed by the thin portion and the thin portions is closely attached and adheres to the support member 37, whereby the cleaning blade A and the cleaning blade B are supported. By forming a shape of the cleaning blade in this way, it is possible to prevent buckling of the cleaning blade at the tip of the support member 37. Thus, trunk abutment of the cleaning blade against the image carrier is controlled. It is possible to concentrate loads at the blade tip.

Specifically, as a blade shape of the cleaning blade A and the cleaning blade B, t1 is 1.7 millimeters, t2 is 3.5 millimeters, t3 is 7 millimeters, t4 is 11 millimeters, L is 3.8 millimeters, d is 1.2 millimeters, thickness T of the support member 37 is 1.6 millimeters, and the JISA hardness is 70 degrees.

In the case of the obtuse angle blade B, in addition to the constitution described above, the obtuse angle blade B has a shape in which the tip ridge portion 38*b* of the cleaning blade pressed against the image carrier is cut into an obtuse angle as in FIG. 7A. Specifically, as shown in FIG. 8D, the tip ridge portion 38*b* is cut by 100 micrometers in a length direction and 200 micrometers in a thickness direction to set the angle θ forming the tip ridge portion 38*b* as an obtuse angle.

Figure 9:
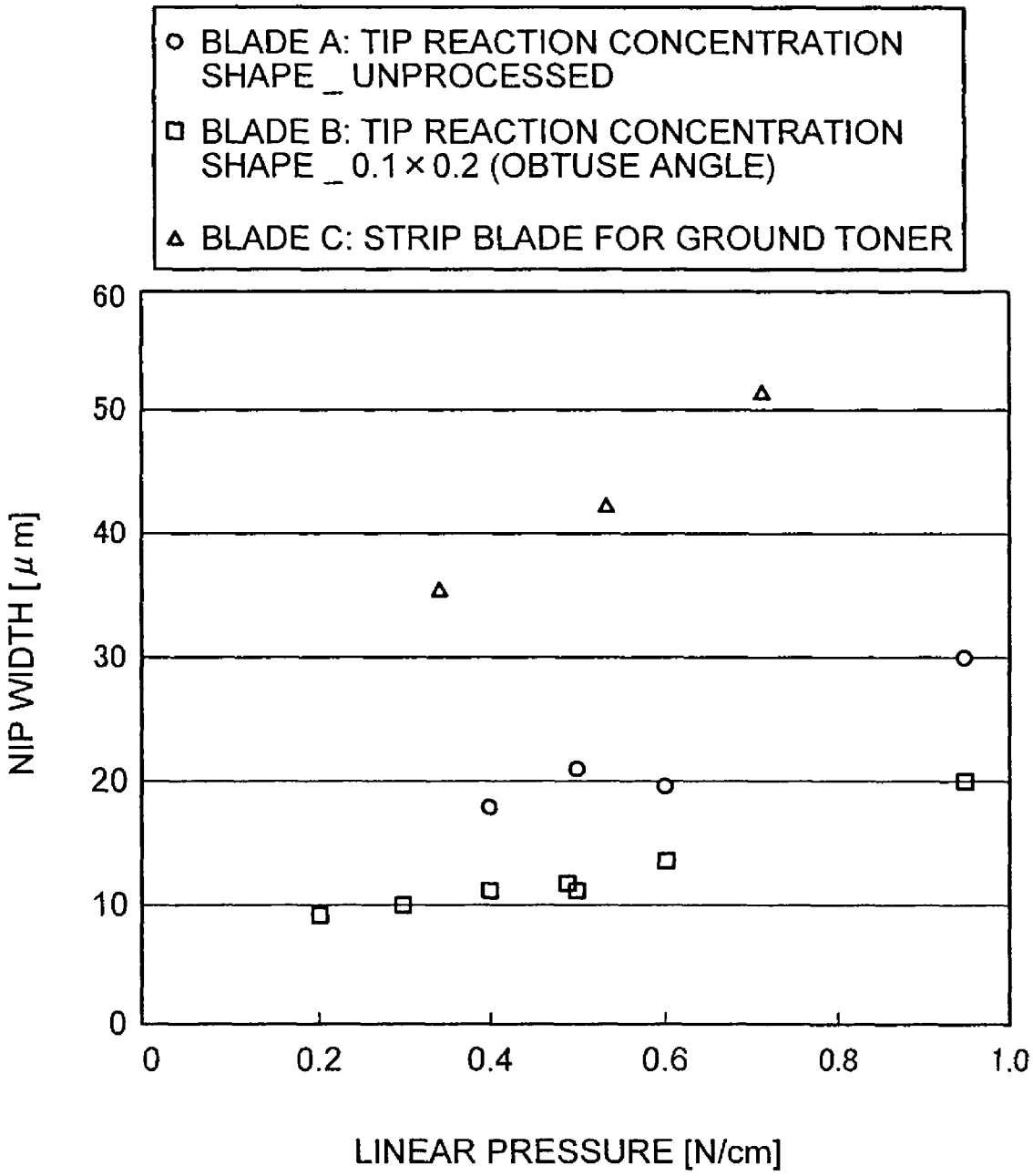
FIG. 9 is a diagram of a relation between linear pressures and nip widths of the cleaning blades A, B, and C shown in FIGS. 8A to 8C.
Figure 10:
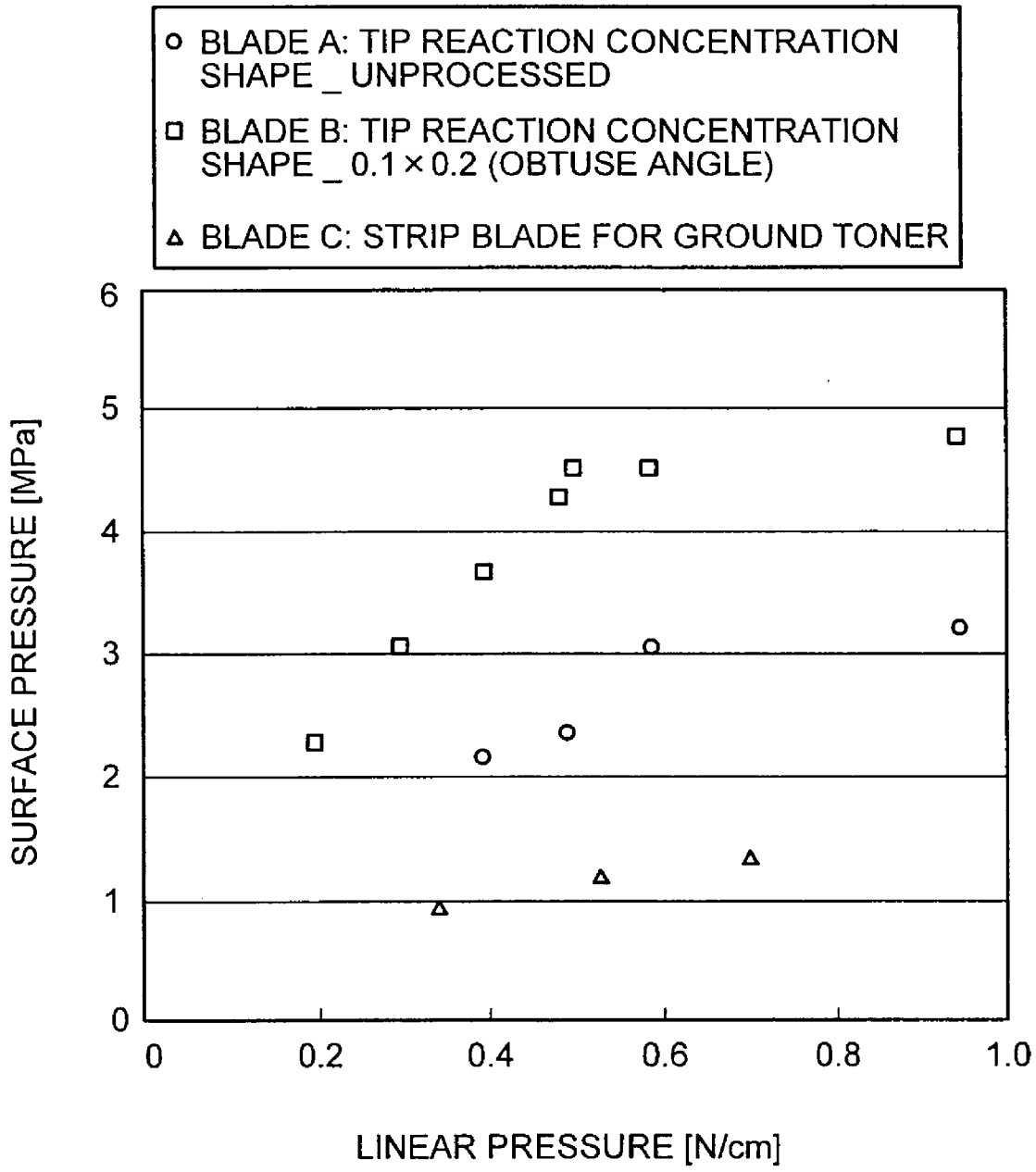
FIG. 10 is a diagram of a relation between linear pressures and surface pressures of the cleaning blades A, B, and C.

A relation between a linear pressure and a contact width is shown in FIG. 9 and a relation between a liner pressure and a surface pressure is shown in FIG. 10 concerning the three types of cleaning blades A, B, and C.

As shown in FIG. 9, when a fixed linear pressure is applied, comparing contact widths of the three types of cleaning blades A, B, and C, the cleaning blade C has a large contact width compared with the other two types of cleaning blades A and B having the tip reaction concentration shape because trunk abutment occurs in the cleaning blade C. On the other hand, when the two types of cleaning blades A and B having the tip reaction concentration shape are brought into abutment against the image carrier, comparing contact widths, a contact width of the cleaning blade B with the blade tip cut into an obtuse angle is smaller than a contact width of the unprocessed blade A. Even when the same linear pressure is applied, a surface pressure tends to be high in the cleaning blade B.

In FIG. 10, a relation between a linear pressure and a surface pressure (calculated from FIG. 9 by dividing the linear pressure by the contact width) is plotted concerning the cleaning blades A, B, and C.

In the cleaning blade C for the conventional ground toner, even when a displacement amount d for pressing the cleaning blade against the image carrier is increased to increase the linear pressure, the contact area simply increases and the surface pressure does not increase sufficiently. Thus, cleaning failure occurs. On the other hand, in the cleaning blades A and B having the tip reaction concentration shape, even when the displacement amount d is increased, the contact width is not increased by trunk abutment. Thus, it is possible to apply the surface pressure required for cleaning the spherical toner. The surface pressure required for cleaning the spherical toner is, as described above, 2.0 MPa or more, desirably, 3.0 MPa or more.

Judging from the comparison of the cleaning blades A and B, the cleaning blade B processed to set the blade tip as an obtuse angle can apply a high surface pressure at a low linear pressure compared with the cleaning blade A.

In the cleaning blade A, it is necessary to apply a linear pressure of about 0.2 N/cm to apply a lowest surface pressure of 2.0 MPa required for cleaning the toner on the image carrier ((B)). It is necessary to apply a linear pressure of about 0.3 N/cm to apply a surface pressure of 3.0 MPa that can clean the toner completely ((A)). On the other hand, in the cleaning blade B, it is necessary to apply a linear pressure of about 0.4 N/cm to apply a surface pressure of 2.0 MPa. It is necessary to apply a linear pressure of about 0.6 to 0.8 N/cm to apply a surface pressure of 3.0 MPa. In this way, by processing the blade tip into an obtuse angle, it is possible to apply a large surface pressure at a smaller linear pressure. For example, it is possible to set a linear pressure, which is applied to set a surface pressure of 3.0 MPa that can clean the toner completely, smaller by about 0.3 to 0.5 N/cm.

In this way, by processing the blade tip into an obtuse angle, it is possible to reduce the contact area of the cleaning blade and the image carrier compared with the contact area at the time when the tip is 90 degrees. In the results shown in FIGS. 9 and 10, only the tip of the blade B is cut into a size of 100 μm×200 μm (an angle is about 115 degrees) to have an obtuse angle. As shown in FIGS. 7A and 7B, if the entire tip surface is cut into an obtuse angle, it is possible to reduce the contact width compared with the contact width at the time when the tip is 90 degrees. The obtuse angle means that an angle is larger than 90 degrees. The obtuse angle in this case is 95 degrees or more and 140 degrees or less. When a tip angle is too close to 90 degrees, the effect of contact area reduction by the obtuse angle is not shown. The cleaning blade is integrated in the image forming apparatus with an initial abutment angle β shown in FIGS. 5 and 6 set between 15 to 30 degrees. Therefore, when the tip angle is set to 140 degrees and the initial abutment angle is set to 30 degrees, an angle formed by the cut surface and the cleaning blade is 10 degrees. When the angle is small, the toner is deposited on a wedge portion to substantially increase the contact area of the cleaning blade and the image carrier. Thus, the surface pressure falls. As a result, cleaning failure can occur.

Figure 11:
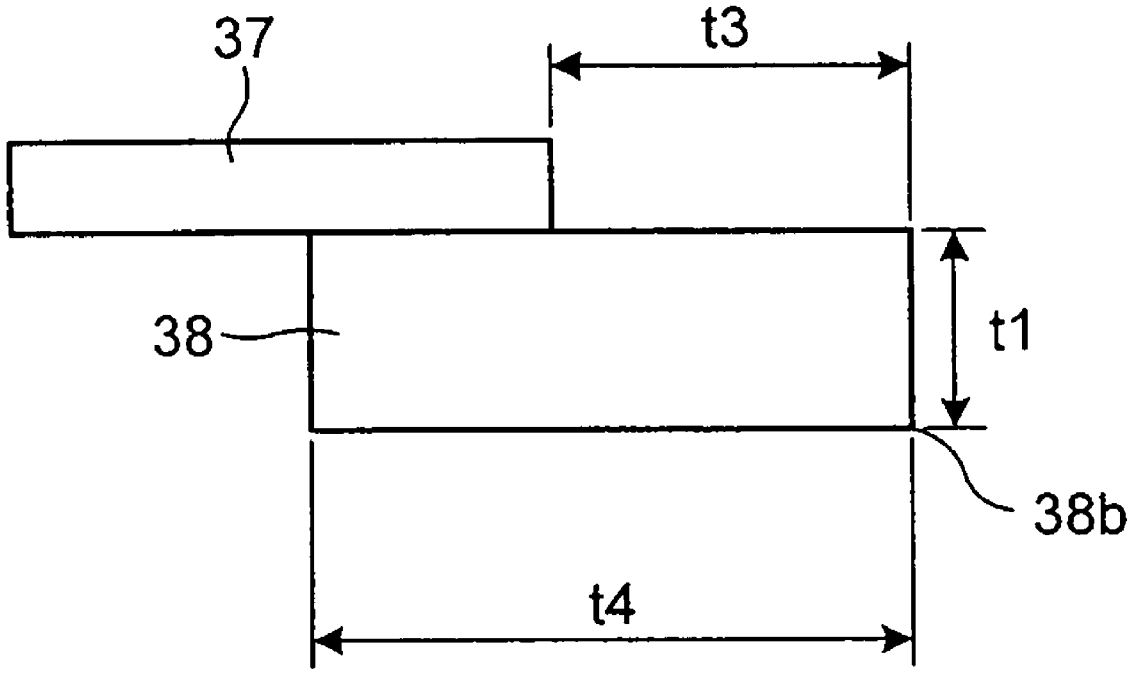
FIG. 11 is a diagram of support for the cleaning blade with free length and thickness thereof set in a fixed relation.

A specific example of the cleaning blade shown in FIG. 5 is shown in FIG. 11. In this example, the cleaning blade 38 is formed in a strip shape such that a relation $1.75 \leqq t3/t1 \leqq 3$ is established between the free length t3 and the thickness t1. Consequently, it is possible to prevent buckling of the cleaning blade 38 at the tip of the support member 37.

Conventionally, as a blade shape for ground toner cleaning, for example, the free length t3 is 8 millimeters and the thickness t1 is 2 millimeters (t3/t1=4). Trunk abutment occurs in the cleaning blade because of buckling. Thus, it is impossible to apply a surface pressure necessary for cleaning the spherical toner. However, it is possible to control buckling of the cleaning blade 38 at the tip of the support member 37 by setting the blade shape to satisfy the relational expression.

In the strip shape shown in FIG. 11 thicker than that in the past, when the angle θ forming the tip ridge portion 38*b* of the cleaning blade is set as an obtuse angle, the contact area of the cleaning blade and the image carrier is also reduced. Compared with the cleaning blade in which the angle forming the tip ridge portion 38*b* of the cleaning blade is 90 degrees, it is possible to apply a surface pressure capable of cleaning the spherical toner at a lower linear pressure.

Figure 12A:
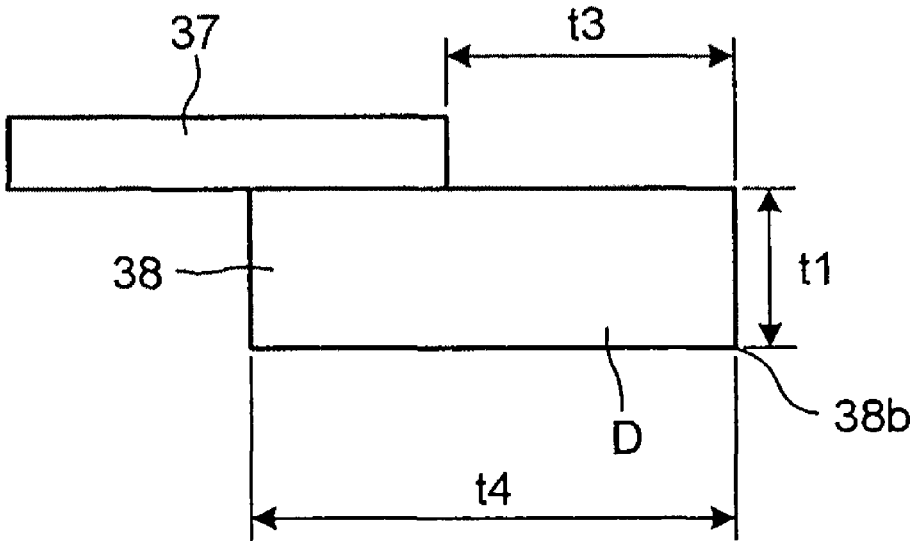
FIG. 12A is a diagram of support for the cleaning blade with an angle forming the tip ridge portion thereof set to 90 degrees.

A relation between a linear pressure and a surface pressure of the cleaning blade D with an angle of 90 degrees at the blade tip (FIG. 12A) and a relation between a linear pressure and a surface pressure of the cleaning blade E with the tip thereof processed into an obtuse angle (100 μm×200 μm) are described below. A blade shape before obtuse angle processing is a strip blade thicker than usual with t1 set to 3.6 millimeters and t3 set to 7 millimeters (t3/t1≅1.95).

Figure 8C:
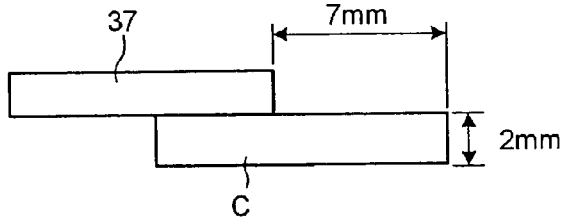
FIG. 8C is a diagram of support for a conventional cleaning blade C in a comparative example.
Figure 8D:
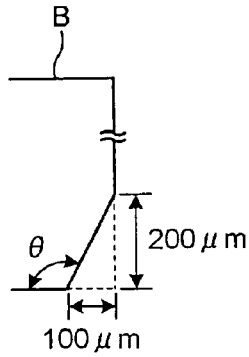
FIG. 8D is an enlarged diagram of a tip of the cleaning blade B according to the present invention.

The cleaning blade C shown in FIG. 8C cannot apply a surface pressure necessary for cleaning the spherical toner. The cleaning blades D and E can apply a surface pressure of 2.0 MPa or 3.0 MPa necessary for cleaning the spherical toner. The cleaning blade E can apply a surface pressure necessary for cleaning the spherical toner even at a low linear pressure compared with the blade D by setting the angle θ forming the tip ridge portion 38*b* of the cleaning blade as an obtuse angle.

Figure 12B:
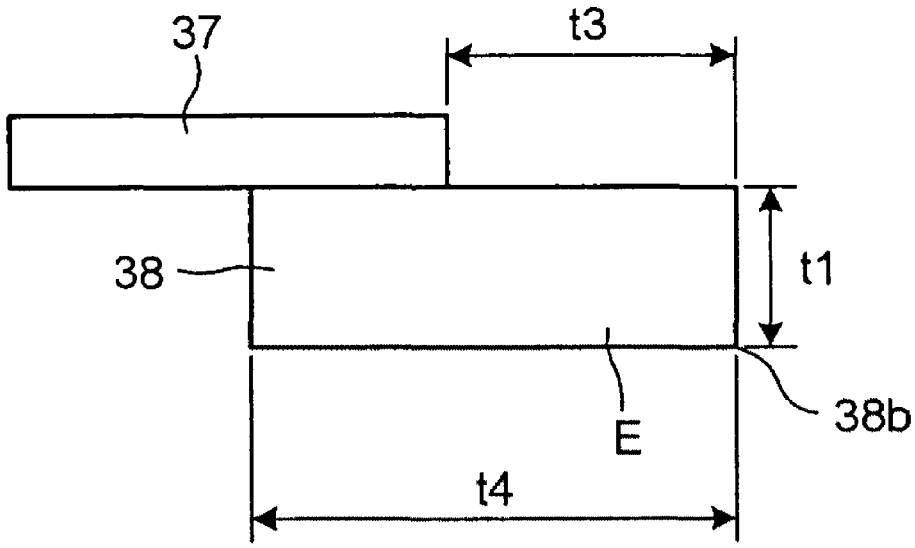
FIG. 12B is a diagram of support for the cleaning blade with an angle forming the tip ridge portion thereof set as an obtuse angle.

In the cleaning blade E shown in FIG. 12B, the same effect is obtained even if the entire tip surface of the cleaning blade is cut or a part of the tip surface of the cleaning blade is cut as shown in FIGS. 7A and 7B.

In the present invention, rubber hardness of the cleaning blade only has to be set between 60 to 80 degrees in the JISA hardness as described above. When the hardness is set to 60 degrees or less, buckling of the cleaning blade at the tip of the support member occurs and a sufficient surface pressure cannot be applied in some cases. Conversely, when the rubber hardness is too high, adhesion with the image carrier is deteriorated and a portion where a sufficient surface pressure is not applied is partially formed to cause cleaning failure.

A blade support constitution using a reinforcing member is explained below.

Figure 13A:
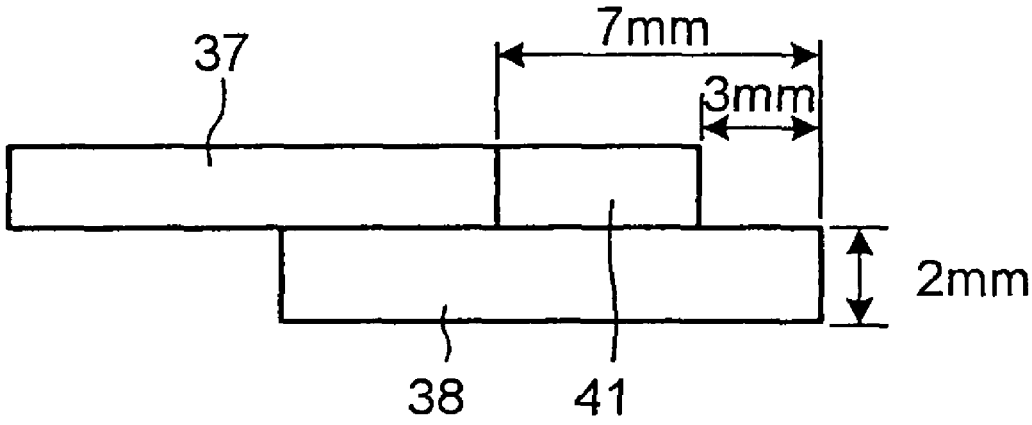
FIG. 13A is a diagram of an example of support for the cleaning blade backed by a reinforcing member.

In FIG. 13A, the cleaning blade 38 having the same thickness as the support member 37 with a thickness of 2 millimeters is provided. A reinforcing member 41 is stuck to the cleaning blade such that a free length of the cleaning blade is 3 millimeters. As the reinforcing member 41, the same metal material as the support member 37 is provided. A length of the free length can be selected appropriately and is not limited to the length described above. A material used in the reinforcing member 41 is not limited to the material described above. It is desirable to use a material having hardness equal to or higher than that of the cleaning blade.

Figure 13B:
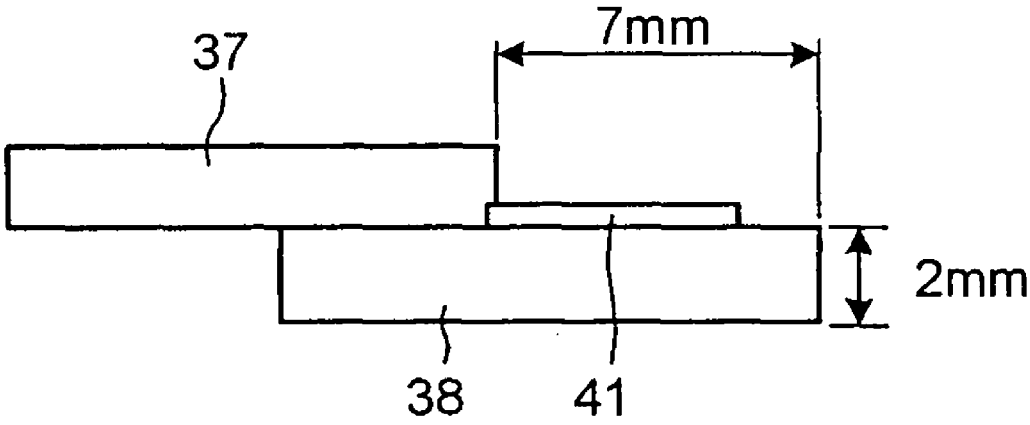
FIG. 13B is a diagram of another example of the support for the cleaning blade backed by a reinforcing member.

In FIG. 13B, the reinforcing member 41 having thickness smaller than thickness of the support member 37 with thickness of 2 millimeters is stuck on the cleaning blade 38. In FIG. 13B, the reinforcing member 41 is not stuck up to the tip end of the cleaning blade 38. However, length of the reinforcing member 41 is not limited to this and can be set arbitrarily.

Rebound resilience of the cleaning blade 38 is explained below.

In the present invention, rebound resilience of an elastic material used for the cleaning blade 38 is set to 30 percent or less at 23° C. The rebound resilience is set to 30 percent or less because vibration of the blade tip is preferably small to clean the spherical toner and rebound resilience is preferably low with respect to abrasion of the cleaning blade.

Conventionally, in cleaning the ground toner, there is an action of spattering the toner deposited on the blade tip with the cleaning blade. Thus, when rebound resilience is low, the spattering effect does not work sufficiently. However, in the case of the spherical toner, since the toner slips through under the cleaning blade before being rebounded, the spattering effect does not act. It is known that, when rebound resilience is high and the blade tip tends to vibrate slightly against the image carrier, the slip-through of the spherical toner is promoted on the contrary.

On the other hand, it is known that lower rebound resilience is advantageous against abrasion of the cleaning blade. In a repeated image forming process, the cleaning blade gradually wears because of rubbing against the image carrier. The inventors consider that, in a mechanism for occurrence of abrasion of the cleaning blade, as a result of the stick slip action of the cleaning blade itself, a polymer (e.g., polyurethane rubber) forming the cleaning blade is torn and fractured through fatigue to cause abrasion. In such a case, the blade tip is torn and cleaning failure occurs from that portion.

However, when rebound resilience is set low, the stick slip action of the cleaning blade itself is controlled. Thus, even after the repeated image forming process, an accumulated number of times of vibration of the blade tip is smaller than that of a high rebound resilience blade and fatigue fracture is also controlled. As a result, even after the repeated image forming process, blade abrasion does not progress and cleaning performance is satisfactorily maintained for a long period of time.

Therefore, it is necessary to set rebound resilience to 30 percent or less at 23° C.

In the present invention, to clean the spherical toner, a heavy load is applied to press the cleaning blade 38 against the image carrier 10. Therefore, blade abrasion and film-shaving of the image carrier increase. Thus, it is possible to control abrasion of the cleaning blade 38 and film-shaving of the image carrier 10 by applying a lubricant on the surface of the image carrier 10. When the image carrier 10 is charged by the charging device 11 using discharge, the surface of the image carrier 10 is gradually modified by discharge and surface energy increases. In this case, it is possible to maintain cleaning performance for the spherical toner over a long time. Thus, it is advisable to provide a lubricant applying device for applying a lubricant on the image carrier 10 in the image forming apparatus according to the present invention.

Figure 14:
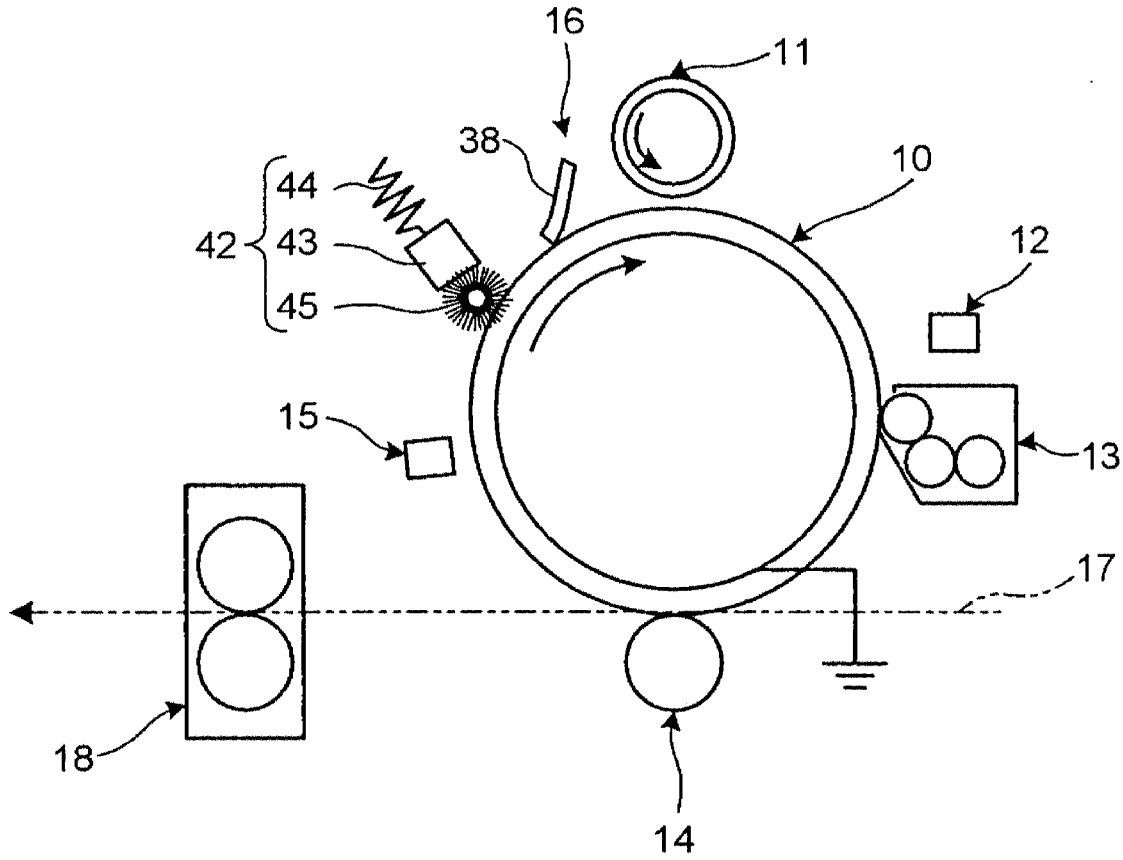
FIG. 14 is a schematic internal diagram of an example of an image forming apparatus including a lubricant applying device.

An example of the lubricant applying device is shown in FIG. 14. A lubricant applying device 42 shown in FIG. 14 forms a lubricant 43 in a solid state, presses the lubricant 43 against a fur brush 45 using a pressure spring 44, and rotates the fur brush 45 to apply the lubricant 43 on the surface of the image carrier 10. Besides, there is also a method of arranging a reservoir of a lubricant in a powder state to be opposed to the surface of an image carrier to supply the lubricant to the image carrier. In FIG. 14, an application position of the lubricant is on an upstream side of the cleaning blade 38 with respect to a moving direction of the image carrier 10. In this case, the lubricant can be removed together with the toner removed by the cleaning blade 38 to make it impossible to uniformly form a film of the lubricant over the surface of the image carrier 10.

Figure 15:
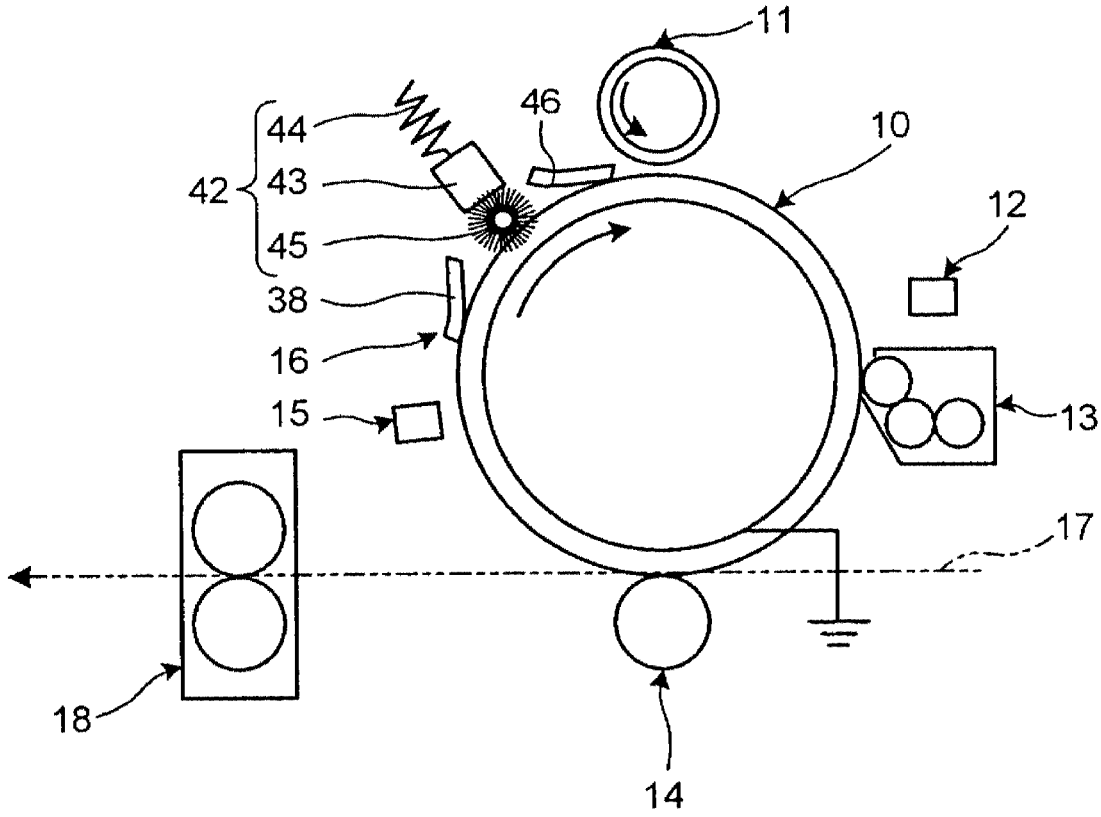
FIG. 15 is a schematic internal diagram of another example of the image forming apparatus including a lubricant applying device.

Thus, as shown in FIG. 15, the lubricant applying device 42 is arranged downstream with respect to the cleaning blade 38 and upstream with respect to the charging device 11 to apply the lubricant using the lubricant applying device 42. Since the lubricant is applied on the surface of the image carrier 10 after removing the toner, it is possible to uniformly apply the lubricant. It is desirable to arrange, as shown in the figure, a spreading member 46 for spreading the lubricant applied on the surface of the image carrier 10 downstream with respect to the lubricant applying device 42. As the spreading member 46, an elastic member such as a urethane rubber blade, an elastic roller, or the like only has to be brought into abutment against the image carrier 10 at an appropriate pressure.

As the lubricant 43, it is suitable to use lamella crystal powder such as zinc stearate. A lamella crystal has a layer structure in which amphipatic molecules are self-organized. When a shearing force is applied, the crystal is cracked along interlamination to make the surface of the image carrier 10 slippery. This action is considered to be effective for lowering a coefficient of friction. It is also possible to use other substances such as various kinds of fatty acid salt, wax, and silicon oil.

Examples of fatty acid include undecylic acid, lauric acid, tridecyl acid, myristic acid, palmitic acid, pendadecyl acid, stearic acid, heptadecyl acid, arachic acid, montan acid, oleic acid, arachidonic acid, caprylic acid, capric acid, and capronic acid. Examples of metallic salt of the fatty acid include salt with metal such as zinc, iron, copper, magnesium, aluminum, and calcium.

Lowering of a coefficient of friction of the tip ridge portion 38*b* of the cleaning blade 38 having the obtuse angle shape is described below.

Figure 16A:
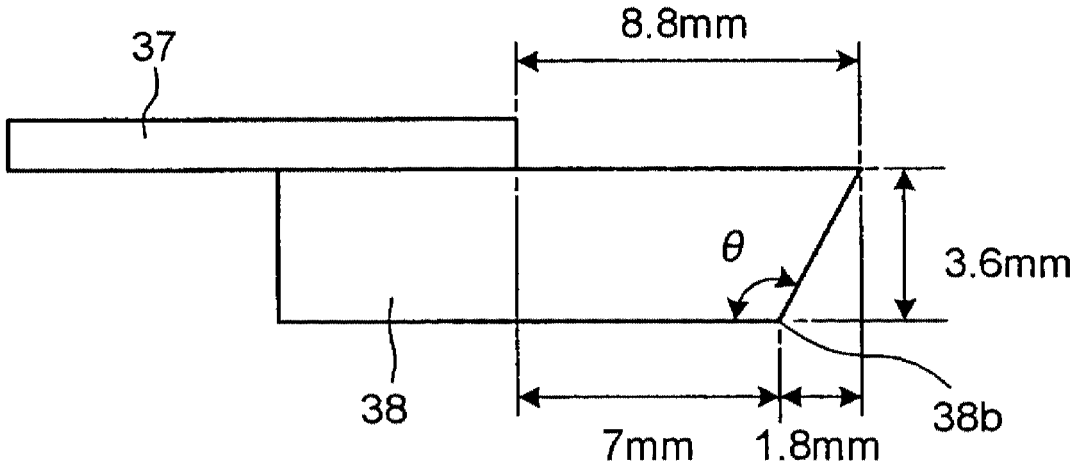
FIG. 16A is a diagram of support for the cleaning blade before a coefficient of friction of the tip ridge portion of the cleaning blade is lowered.

Specifically, as shown in FIG. 16A, the cleaning blade 38 made of elastic rubber is supported by the support member 37. To prevent buckling from occurring, the cleaning blade 38 has thickness of 3.6 millimeters, free length of a blade lower surface of 7 millimeters, and free length of a blade upper surface of 8.8 millimeters. The angle θ of the tip ridge portion 38*b* formed by the blade lower surface and the tip surface is set as an obtuse angle. By adopting such a blade shape, a contact width between the cleaning blade 38 and the image carrier 10 is set appropriately to secure the surface pressure of 2.0 to 3.0 MPa necessary for cleaning the spherical toner.

Figure 16B:
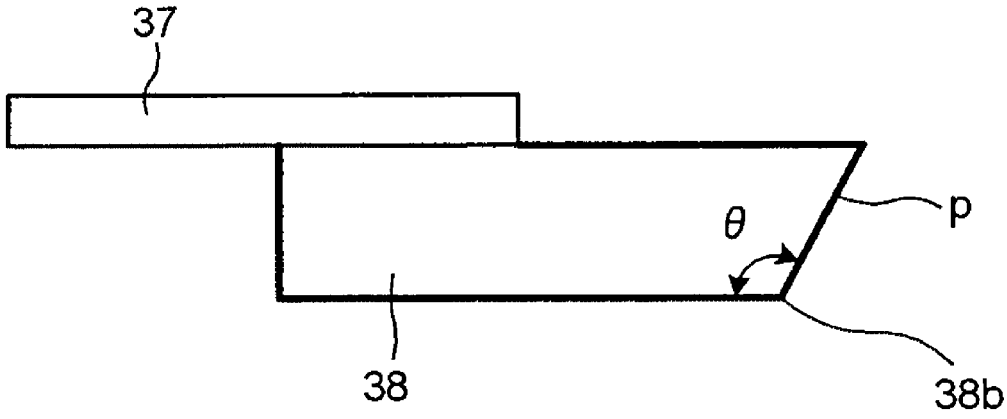
FIG. 16B is a diagram of support for the cleaning blade after a coefficient of friction of the tip ridge portion of the cleaning blade is lowered.

The cleaning blade 38 is formed by lowering a coefficient of friction of the tip ridge portion 38*b*, which is pressed against the image carrier 10 serving as the member to be cleaned, and reducing a coefficient of friction between the cleaning blade 38 and the image carrier 10. Specifically, as shown in FIG. 16B, coating p for lowering of a coefficient of friction can be applied to the surface of the cleaning blade 38. However, instead, although not shown in the figure, if fluorine is impregnated in the cleaning blade 38 to lower a coefficient of friction, fluorine soaks into the cleaning blade 38 to make it possible to maintain the effect of lowering of a coefficient of friction over a longer time.

It is possible to generally explain an effect of treatment for lowering a coefficient of friction of the tip of the cleaning blade 38 as follows.

In general, when a linear pressure for pressing the cleaning blade 38 against the image carrier 10 is f [N/cm] and a width in a longitudinal direction of the cleaning blade 38 is L [cm], a total load for pressing the cleaning blade 38 against the image carrier 10 is N=f×L [g]. In this case, when a coefficient of friction acting between the cleaning blade 38 and the image carrier 10 is μ, a frictional force acting between the cleaning blade 38 and the image carrier 10 is F=μN.

A torque T generated by rubbing of the image carrier 10 and the cleaning blade 38 is represented as follows using a radius "r" of the image carrier 10.

$$T=r\times F=r\times\mu N$$

When a blade shape and a blade material are the same and a diameter of an image carrier abutting against the cleaning blade 38 is the same, a certain fixed total load N has to be applied to apply a surface pressure necessary for cleaning the spherical toner.

Therefore, to lower the torque T while maintaining a load necessary for cleaning the spherical toner, the coefficient of friction μ between the cleaning blade 38 and the image carrier 10 has to be lowered. Conventionally, as a method of lowering the coefficient of friction μ of the surface of the image carrier 10, for example, a method of applying a lubricant on the surface is known. As a result of examination of the investors, it is known that a torque does not always fall even if the lubricant is applied. A result of an experiment showing an example of the result is described below.

In the case of an image formation process using a roller charging system subjected to AC superimposition, torques acting between the cleaning blade 38 and the image carrier 10 at the time when zinc stearate is applied on the surface of the image carrier 10 and at the time when zinc stearate is not applied are compared.

Conditions for the experiment are as described below.

Cleaning blade 38: A cleaning blade for the conventional ground toner (with thickness of 2 millimeters and free length of 7 millimeters)

(Length in a longitudinal direction of the cleaning blade: 325 millimeters)

A torque at the time of cleaning operation was measured using a Jupiter machine and averages were compared.

Diameter of the image carrier 10: φ30.

A result of the experiment is shown in Table 2 below.

TABLE 2

| Condition | Torque [Kg · cm] |
|---|---|
| Zinc stearate not applied | 1.3 |
| Zinc stearate applied | 1.9 |

As shown in the table, when zinc stearate is applied as a lubricant, torque increases rather than decreasing. It is considered that this is because, even when a lubricant is applied for the purpose of lowering μ of the surface of the image carrier 10, zinc stearate is deteriorated by discharge of the charging device and loses lubricity and surface energy or the like of the surface of the image carrier 10 increases, resulting in the increase in the torque due to rubbing of the cleaning blade 38 and the image carrier 10.

In this way, even when the lubricant is applied on the surface of the image carrier 10, to maintain the low μ state of the surface of the image carrier 10, it is necessary to optimize an amount of application of zinc stearate and realize an application balance with which the lubrication effect by zinc stearate exceeds the increase in surface energy due to deterioration of zinc stearate. Thus, it is difficult to lower μ of the surface of the image carrier 10 through application of the lubricant and reduce the torque between the cleaning blade 38 and the image carrier 10.

Therefore, as a result of the repeated image formation process, it is found that, to lower the changing coefficient of friction μ between the surface of the image carrier 10 and the cleaning blade 38, it is desirable to lower a coefficient of friction of the cleaning blade 38 itself. This is a method of reducing the torque between the cleaning blade 38 and the image carrier 10 more stably.

A comparative experiment was performed concerning an effect that, when a coefficient of friction of the tip ridge portion 38*b* of the cleaning blade 38 was lowered, a driving torque for the image carrier 10 generated at the time of rubbing with the image carrier 10 fell. A result of the experiment is described below.

In this experiment, the torque generated at the time of a cleaning operation was measured and a relation of magnitudes of the torque was compared.

Conditions for the experiment are as described below.

Cleaning blade A: A cleaning blade for the conventional ground toner (with thickness of 2 millimeters and free length of 7 millimeters: a shape is as shown in FIG. 8C)

Cleaning blade B: A tip obtuse angle blade (a shape is as shown in FIG. 13A)

Cleaning blade C: A tip obtuse angle blade with a coefficient of friction of a tip thereof lowered (a shape is as shown in FIG. 13B)

(Note: Length in a longitudinal direction of the cleaning blades A, B, and C: 325 millimeters)

Image carrier: φ30

A result of the experiment is as shown in Table 3 below.

TABLE 3

| | Toner | Blade | Linear pressure [N/cm] | Torque [Kgf · cm] |
|---|---|---|---|---|
| Condition 1 | Ground toner | Blade A (for ground toner) | 0.2 | 1.8 |
| Condition 2 | Spherical toner | Blade B | 0.95 | 3.8 |
| Condition 3 | Spherical toner | Blade C (low μ treatment) | 0.95 | 2.7 |

For comparison, a torque at the time when the ground toner was cleaned by the conventional cleaning blade (condition 1) was about 1.8 kgf·cm. On the other hand, in the blade B with the tip thereof processed into an obtuse angle that was capable of applying the surface pressure of 2.0 to 3.0 MPa necessary for cleaning the spherical toner, when a linear pressure of 0.95 N/cm was applied, a torque was about 3.8 kgf·cm, which is twice or more as large as the torque under the condition 1.

Under the condition 3, as a result of using the cleaning blade C obtained by applying the low μ processing to the tip of the cleaning blade B, when a linear pressure of 0.95 N/cm was applied, a torque was about 2.7 kgf·cm. Thus, the torque was successfully reduced.

In this way, by lowering a coefficient of friction of the tip ridge portion 38*b* of the cleaning blade 38, even when a load capable of cleaning the spherical toner is applied, it is possible to reduce a torque due to rubbing of the image carrier 10 and the cleaning blade 38. As a method of lowering a coefficient of friction of the tip ridge portion 38*b* of the cleaning blade 38, a method of impregnating fluorine in the cleaning blade is used. In this case, since fluorine resin is impregnated into the cleaning blade from the surface thereof, it is possible to lower a coefficient of friction over a long time.

On the other hand, it is also possible to coat a substance with a low coefficient of friction over the surface of the cleaning blade 38. Any method of lowering a coefficient of friction can be used as long as a coefficient of friction is lowered compared with that of polyurethane conventionally used as the cleaning blade 38.

In the image forming apparatus according to the present invention, a process cartridge that includes at least the cleaning device 16 described above and the image carrier 10 integrally and makes the cleaning device 16 and the image carrier 10 detachably attachable to the image forming apparatus body can be constituted. This makes it possible to provide a process cartridge that can obtain a cleaning constitution with a low linear pressure and a high surface pressure that can surely clean the toner having small and spherical toner particles. In addition, it is possible to facilitate maintenance such as replacement, repairing, and supply of a toner and realize a reduction in a size of the image forming apparatus body.

In the example described above, the present invention is applied to the image forming apparatus of the direct transfer system that directly transfers a toner image, which is formed on the photosensitive member serving as the image carrier, to the recording medium without intervention of an intermediate transfer member and records an image, and the process cartridge and the cleaning device for the image forming apparatus. Naturally, it is also possible to apply the present invention to an image forming apparatus of an indirect transfer system that transfers a toner image formed on a photosensitive member to a recording medium via an intermediate transfer member and records an image, and a process cartridge and a cleaning device for the image forming apparatus. In this case, it is possible to apply the present invention not only to a primary cleaning device that removes a primary transfer residual toner on the photosensitive member serving as the image carrier but also to a secondary cleaning device that removes a secondary transfer residual toner on the intermediate transfer member serving as the image carrier.

In the above explanation, the present invention is applied to the monochrome image forming apparatus, and the process cartridge and the cleaning device for the image forming apparatus. It is also possible to apply the present invention to a color image forming apparatus of a revolver system and a tandem system, and a process cartridge and a cleaning device for the image forming apparatus. It is also possible to apply the present invention to an image forming apparatus including plural process cartridges and plural cleaning devices.

It is possible to provide an image forming apparatus that can obtain a cleaning constitution with a low linear pressure and a high surface pressure that can surely clean the toner having small and spherical toner particles, and a process cartridge and a cleaning device for the image forming apparatus.

Figure 17:
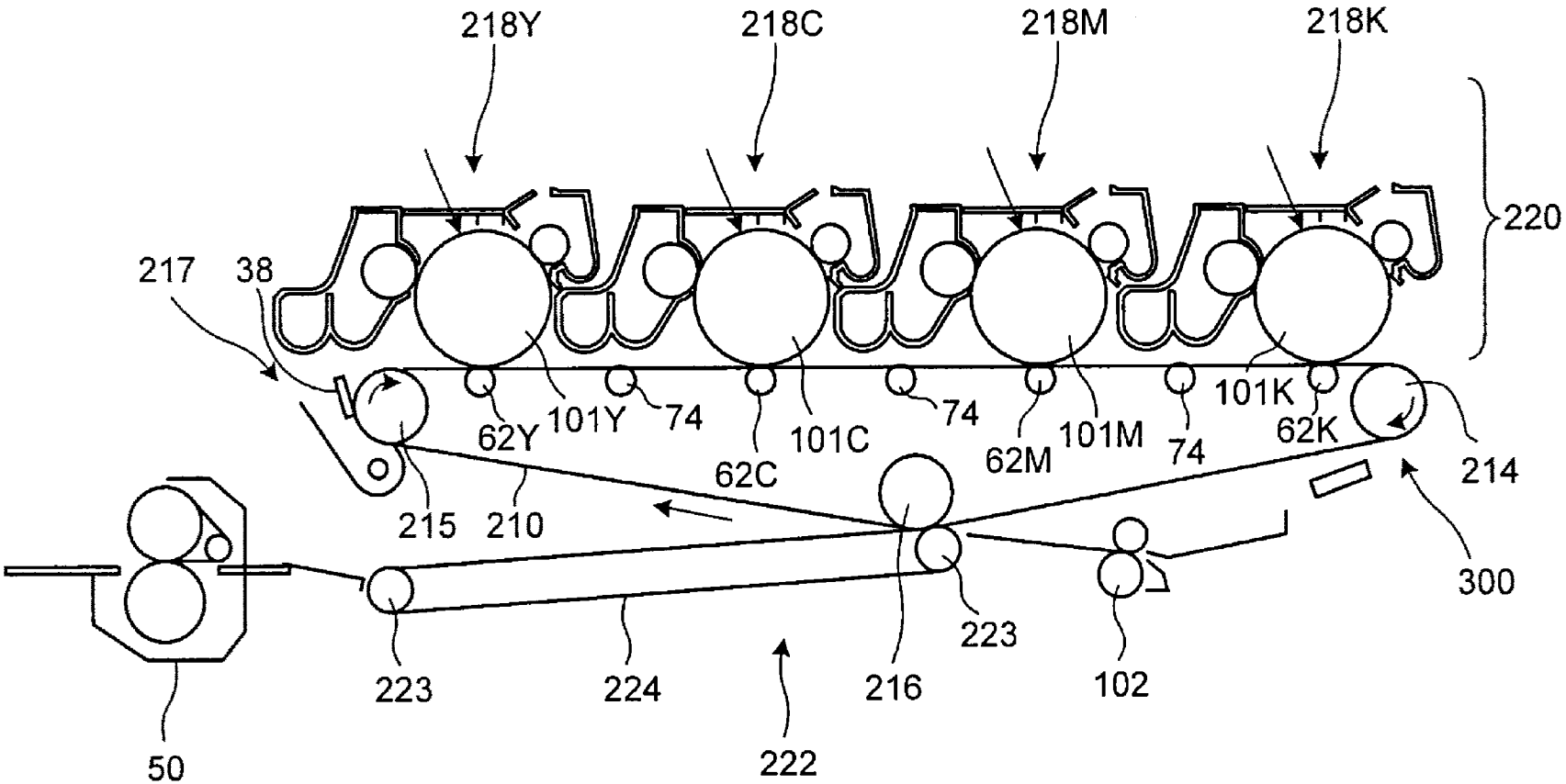
FIG. 17 is a schematic diagram of an intermediate transfer unit including an intermediate transfer member serving as a member to be cleaned and a constitution around the intermediate transfer unit.

An intermediate transfer unit 300 including an intermediate transfer member serving as a member to be cleaned and a constitution around the intermediate transfer unit 300 are shown in FIG. 17. The present invention applied to a secondary cleaning device that removes a secondary residual toner on an intermediate transfer belt 210 serving as an intermediate transfer member is explained below with reference to FIG. 17.

In the intermediate transfer unit 300, the intermediate transfer belt 210 is wound around a tension roller 214, a driving roller 215, a secondary transfer backup roller 216, four intermediate transfer bias rollers 62Y, 62C, 62M, and 62K for yellow, cyan, magenta, and black, three ground rollers 74, and the like. A belt cleaning device 217 is provided beside the intermediate transfer belt 210 as a secondary cleaning device.

The intermediate transfer belt 210 is caused to move endlessly clockwise in the figure according to rotation of the driving roller 215 driven by a not-shown belt driving motor. The four intermediate transfer bias rollers 62Y, 62C, 62M, and 62K are disposed to be in contact with a base layer side (an inner peripheral surface side) of the intermediate transfer belt 210 and receive application of an intermediate transfer bias from a not-shown power supply, respectively. The intermediate transfer belt 210 is pressed toward photosensitive members 101Y, 101C, 101M, and 101K from a base layer side thereof to form intermediate transfer nips, respectively. In the respective intermediate transfer nips, intermediate transfer electric fields are formed between the photosensitive members and the intermediate transfer bias rollers because of an influence of the intermediate transfer bias. A Y toner image formed on the photosensitive member 101Y for Y is intermediately transferred onto the intermediate transfer belt 210 because of influences of the intermediate transfer electric field and a nip pressure. C, M, and K toner images formed on the photosensitive members 101C, 101M, and 101K for C, M, and K are intermediately transferred to be sequentially superimposed on the Y toner image. A toner image with four colors superimposed (hereinafter, "four-color toner image"), which is a multiple toner image, is formed on the intermediate transfer belt 210 according to the superimposing intermediate transfer.

In the intermediate transfer belt 210, the ground rollers 74 are in abutment against portions among the intermediate transfer nips from the inner side of the intermediate transfer belt 210. The ground rollers 74 are formed of a conductive material. The ground rollers 74 prevent an electric current caused by the intermediate transfer bias, which is transmitted to the intermediate transfer belt 210 from the intermediate transfer bias rollers 62Y, 62C, 62M, and 62K in each of the intermediate transfer nips, from being leaked to the other intermediate transfer nips and the process cartridge.

The four toner image transferred to be superimposed on the intermediate transfer belt 210 is secondarily transferred onto not-shown transfer paper by a secondary transfer nip described later. A transfer residual toner remaining on the surface of the intermediate transfer belt 210 after passing the secondary transfer nip is cleaned by the cleaning blade 38 made of elastic rubber of the belt cleaning device 217 that holds the intermediate transfer belt 210 with the driving roller 215 on the left side in the figure.

The cleaning blade 38 is supported by a not-shown support member and presses a tip thereof against the intermediate transfer belt 210, which is performing surface movement, in a counter direction. As in the example described above, an angle forming a tip end ridge portion of the cleaning blade 38 is set as an obtuse angle. The tip ridge portion is pressed against the intermediate transfer belt 210 serving as the member to be cleaned at a surface pressure of 2.0 MPa or more.

In particular, in the intermediate transfer unit 300 that carries a plurality of colors of toners like the intermediate transfer belt 210, since a transfer residual toner is satisfactorily removed, it is possible to prevent occurrence of color mixing due to deposition of transfer residual toners of different colors on the photosensitive member 1.

In the intermediate transfer unit 300, at least the belt cleaning device 217 and the intermediate transfer belt 210 are integrated to constitute the process cartridge. Thus, it is possible to make the belt cleaning device 217 and the intermediate transfer belt 210 detachably attachable to a not-shown image forming apparatus body.

In FIG. 17, reference numeral 220 denotes an image forming device. The image forming device 220 includes four monochrome image forming units 218Y, 218C, 218M, and 218K of yellow, cyan, magenta, and black. Reference numeral 102 denotes a registration roller and 222 denotes a secondary transferring and conveying device, in which a transfer conveyance belt 224 is wound around two rollers 223. Reference numeral 50 denotes a fixing device.

In the explanation of the example described above, the member to be cleaned is the image carrier 10 or the intermediate transfer belt 210 such as a photosensitive member or an intermediate transfer member, and a residual toner remaining on the image carrier 10 or the intermediate transfer belt 210 transfer member after image transfer is removed by the cleaning blade 38. However, the member to be cleaned is not limited to the image carrier and can be, for example, a charging roller of a charging device.

Figure 18:
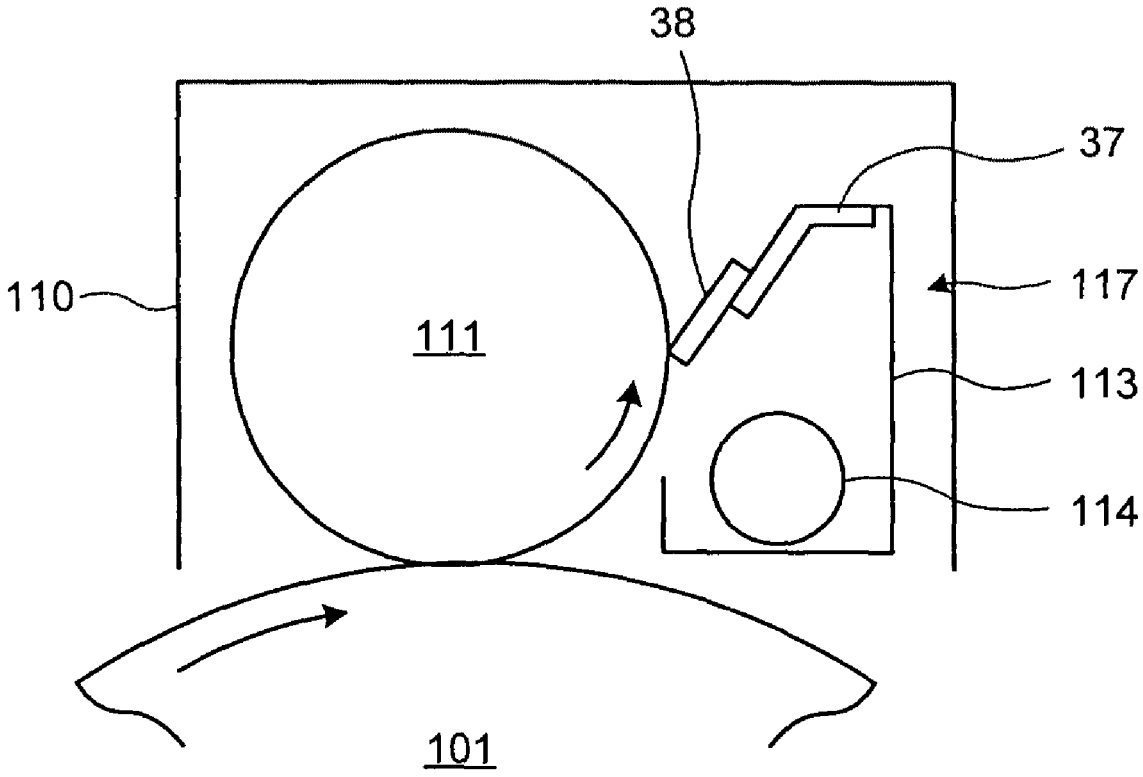
FIG. 18 is a schematic diagram of a charging device including a charging roller serving as a member to be cleaned and a constitution around the charging device.
Figure 19A:
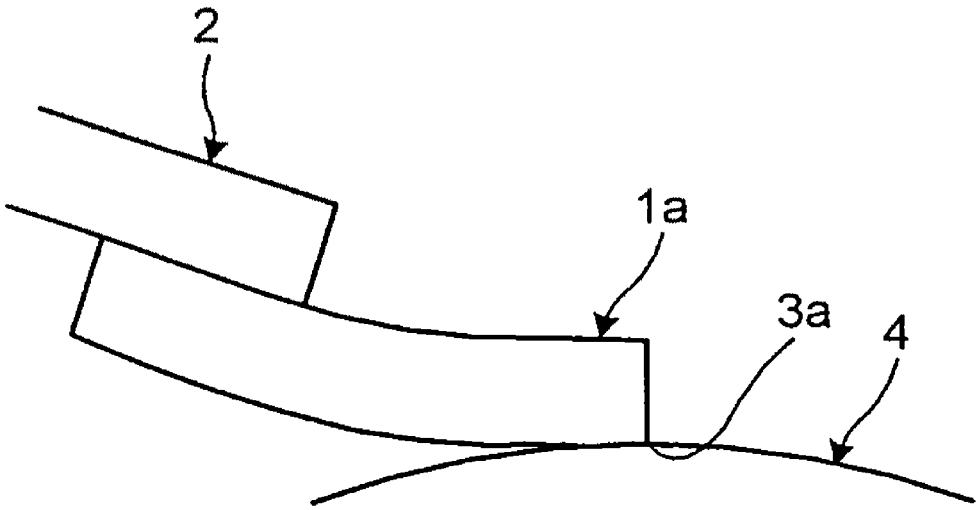
FIGS. 19A and 19B are diagrams of support for conventional cleaning blades having different shapes.
Figure 19B:
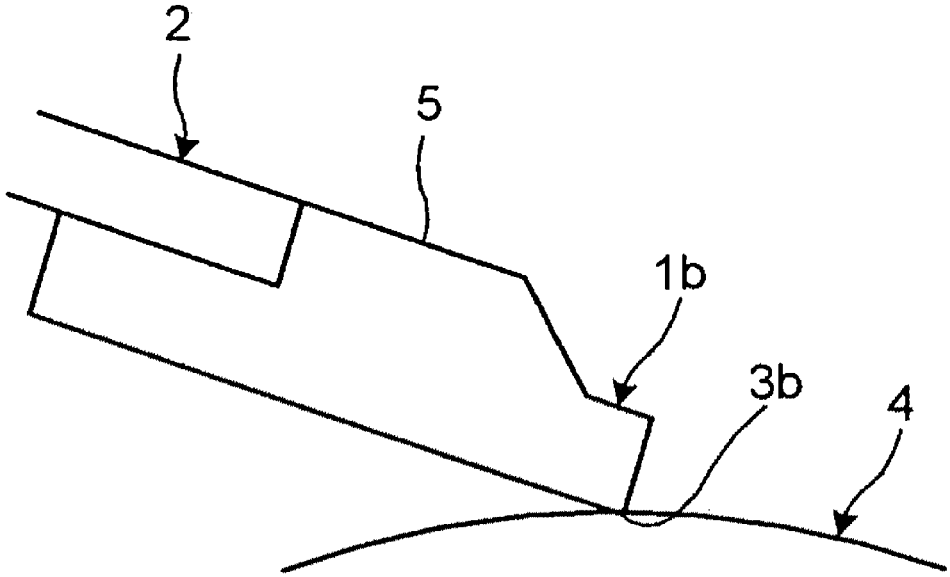
Figure 20A:
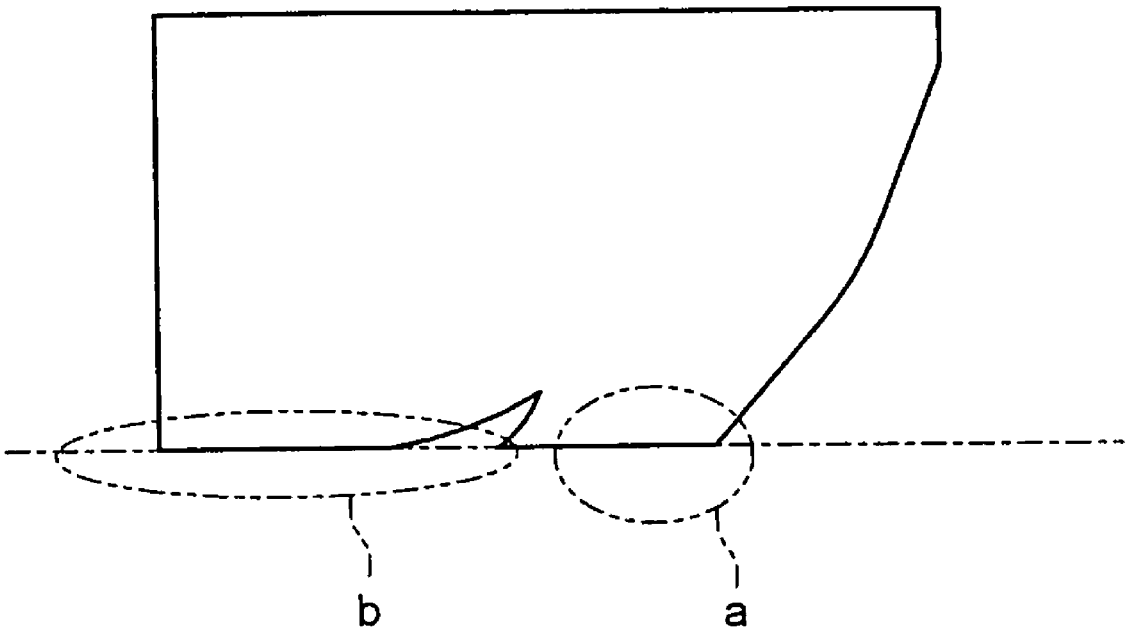
FIGS. 20A and 20B are enlarged diagrams of blade tips of the conventional cleaning blades in a state in which the cleaning blades are pressed against an image carrier.
Figure 20B:
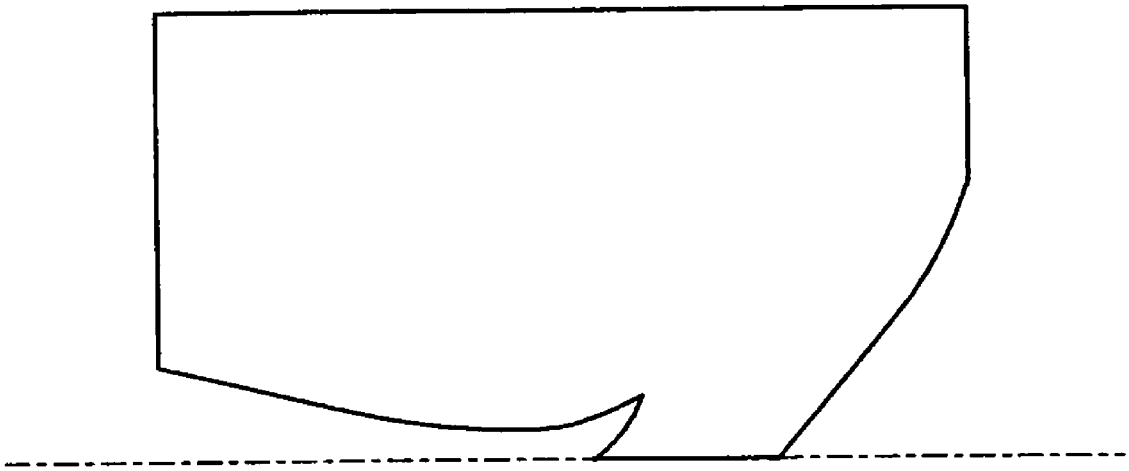
Figure 21A:
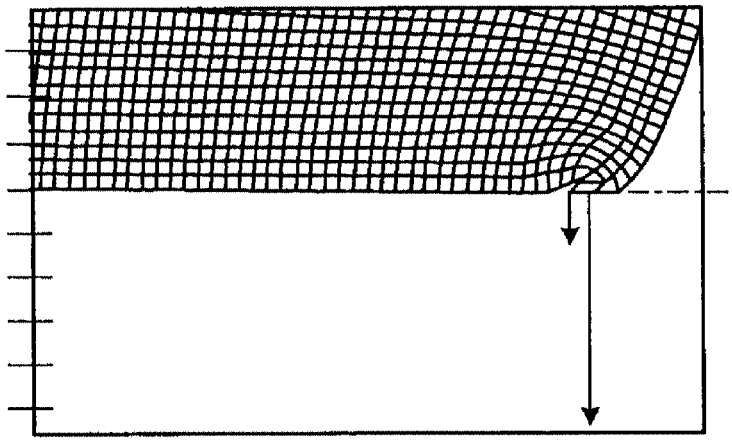
FIGS. 21A and 21B are pressure distribution diagrams in the states shown in FIGS. 20A and 20B, respectively.
Figure 21B:
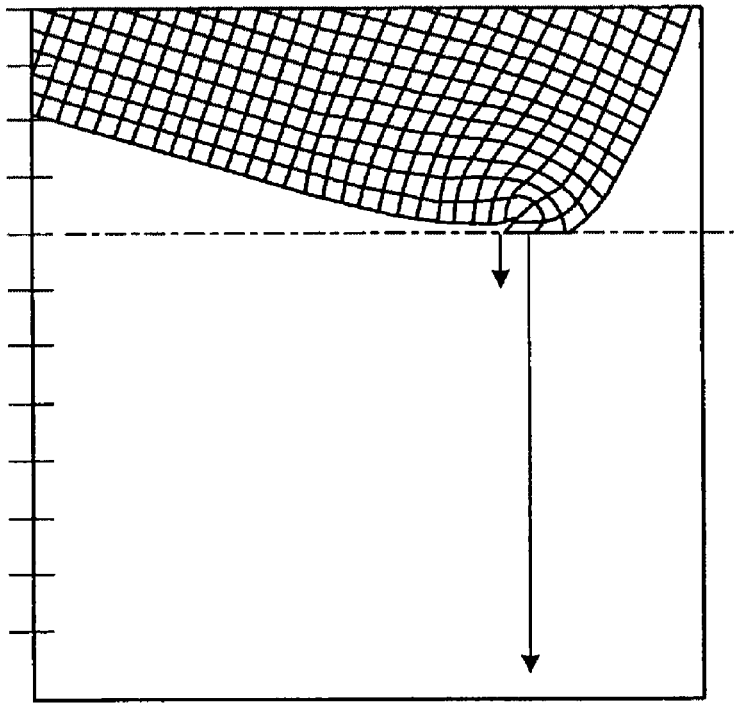

A charging device including a charging roller serving as a member to be cleaned and a schematic constitution around the charging device are shown in FIG. 18. As shown in the figure, a charging device 110 includes a charging roller cleaning device 117 that removes a toner deposited on a charging roller 111. The charging roller cleaning device 117 includes a charge removing casing 113, the support member 37, the cleaning blade 38 serving as an elastic cleaning blade, and a charge removing and collecting screw 114.

A toner that cannot be completely removed by the photosensitive cleaning device of the residual toner deposited on the photosensitive member 101 reaches a portion opposed to the charging roller 111 that is a charging area. Since the charging roller 111 performs charging near or in contact with the photosensitive member 101, some part of the toner reaching the charging area is deposited on the charging roller 111. The toner deposited on the charging roller 111 in the charging area is removed from the surface of the charging roller 111 by the cleaning blade 38 of the charging roller cleaning device 117.

The cleaning blade 38 is supported by the support member 37 and presses the tip thereof against the charging roller 111, which is performing surface movement, in a counter direction. As in the example described above, an angle forming the tip end ridge portion of the cleaning blade 38 is set as an obtuse angle. The tip ridge portion is pressed against the charging roller 111 serving as the member to be cleaned at a surface pressure of 2.0 MPa or more.

Since it is possible to satisfactorily remove the residual toner deposited on the charging roller 111, it is unnecessary to adopt a charging roller of a non-contact type as the charging roller 111 for prevention of toner deposition. Thus, it is possible to adopt the charging roller 111 of a contact type. Note that, in the charging device 110, since at least the charging roller cleaning device 117 and the charging roller 111 are integrated to constitute a process cartridge, it is possible to make the charging roller cleaning device 117 and the charging roller 111 detachably attachable to a not-shown image forming apparatus.

According to the present invention, it is possible to increase a surface pressure without reducing a contact width to increase a linear pressure, surely clean even a toner having small and spherical toner particles, and obtain a cleaning constitution with a low linear pressure and a high surface pressure by specifying a shape of the cleaning blade.

Furthermore, according to the present invention, it is possible to increase a surface pressure without reducing a contact width of the cleaning member with the image carrier to efficiently increase a linear pressure and prevent slip-through of a toner compared with a load applied to the cleaning member, and surely clean a residual toner remaining on the image carrier after image transfer.

Moreover, according to the present invention, it is possible to more surely increase a surface pressure without reducing a contact width to increase a linear width.

Furthermore, according to the present invention, it is possible to set the angle forming the tip ridge portion as an obtuse angle and increase a surface pressure without reducing a contact width to increase a linear pressure.

Moreover, according to the present invention, it is possible to more surely set an angle forming the tip ridge portion as an obtuse angle and increase a surface pressure without reducing a contact width to increase a linear pressure.

Furthermore, according to the present invention, it is possible to more satisfactorily clean the toner having small and spherical toner particles.

Moreover, according to the present invention, it is possible to prevent unevenness of contact of the cleaning blade with the cleaning member to be cleaned from occurring and prevent the cleaning blade from being affected by scratches, protrusions, and the like on the surface of the member to be cleaned to cause cleaning failure. This makes it possible to satisfactorily clean the toner having small and spherical toner particles.

Furthermore, according to the present invention, it is possible to increase a surface pressure without increasing a linear pressure and prevent harmful effects from occurring, for example, prevent abrasion of the member to be cleaned from increasing, prevent torque of the member to be cleaned from increasing, and prevent abrasion of the cleaning blade from increasing. This makes it possible to improve cleaning performance for the toner having small and spherical toner particles, cleaning of which is difficult.

Moreover, according to the present invention, it is possible to more surely increase a surface pressure without increasing a linear pressure.

Furthermore, according to the present invention, it is possible to secure cleaning performance for the toner having small and spherical toner particles and eliminate harmful effects caused by excessive increase in the linear pressure.

Moreover, according to the present invention, it is possible to surely prevent occurrence of harmful effects caused by excessive increase in the linear pressure.

Furthermore, according to the present invention, it is possible to obtain a cleaning constitution with a low linear pressure and a high surface pressure by controlling a fall in a surface pressure due to trunk abutment of the cleaning blade and specifying a shape of the cleaning blade.

Moreover, according to the present invention, it is possible to obtain a cleaning constitution with a low linear pressure and a high surface pressure by controlling a fall in a surface pressure due to trunk abutment of the cleaning blade and specifying a shape of the cleaning blade and a support constitution for the cleaning blade.

Furthermore, according to the present invention, it is possible to obtain a cleaning constitution with a low linear pressure and a high surface pressure by controlling a fall in a surface pressure due to trunk abutment of the cleaning blade and specifying a support constitution for the cleaning blade.

Moreover, according to the present invention, it is possible to obtain a cleaning constitution with a low linear pressure and a high surface pressure by controlling a fall in a surface pressure due to trunk abutment of the cleaning blade and specifying a material of the cleaning blade.

Furthermore, according to the present invention, it is possible to obtain a cleaning constitution with a low linear pressure and a high surface pressure by specifying a material of the cleaning blade while preventing stick slip of the cleaning blade and controlling abrasion of the cleaning blade.

Moreover, according to the present invention, it is possible to reduce frictional resistance of the cleaning blade against the member to be cleaned and control torque of the member to be cleaned to be small to prevent an increase in a size of the driving motor and prevent an increase in cost.

Furthermore, according to the present invention, it is possible to reduce frictional resistance of the cleaning blade against the member to be cleaned to control a driving torque of the member to be cleaned to be small with a simple method.

Moreover, according to the present invention, it is possible to perform cleaning more surely according to a cleaning constitution with a low linear pressure and a high surface pressure and obtain a satisfactory image quality.

Furthermore, according to the present invention, it is possible to facilitate maintenance of a process cartridge such as replacement, repairing, and supply of a toner and realize a reduction in a size of the image forming apparatus body.

Moreover, according to the present invention, it is possible to provide an image forming apparatus that can obtain a cleaning constitution with a low linear pressure and a high surface pressure.

Furthermore, according to the present invention, it is possible to provide an image forming apparatus having an improved abrasion resistance property of the image carrier.

Moreover, according to the present invention, it is possible to provide an image forming apparatus including the image carrier with improved electric stability.

Furthermore, according to the present invention, it is possible to provide an image forming apparatus with durability improved by reducing film-shaving of the image carrier.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A cleaning device that cleans a toner on an image carrier, the cleaning device comprising:

a blade; and a support member that supports the blade, wherein the blade includes:

a top surface;

a bottom surface substantially parallel to the top surface;

a tip surface disposed perpendicular to the top and bottom surfaces and connected to the bottom surface; and a cut surface having two ends that connect the top surface and the tip surface, the cut surface provided by obliquely cutting a part of the top surface and the tip surface to set an angle forming a tip ridge portion of the blade as an obtuse angle relative to the top surface, the tip ridge portion being formed at one end of the cut surface at an intersection with the top surface, the cut surface being less than an entirety of the tip surface, and wherein the support member is configured to support the blade such that only the tip ridge portion of the cut surface presses a surface of the image carrier.

2. The cleaning device of claim 1, wherein the blade has a structure that includes a right angle in a broad thickness direction of the blade and on an opposite side of the obtuse angle.

3. The cleaning device of claim 1, wherein the obtuse angle is 95 degrees.

4. The cleaning device of claim 1, wherein the obtuse angle is 95 degrees or more and 140 degrees or less.

5. The cleaning device of claim 1, wherein the tip ridge portion is configured to press the surface to be cleaned with a pressure of 2.0 MPa or more.

6. The cleaning device of claim 1, wherein the tip ridge portion is configured to press the surface to be cleaned with a pressure of 3.0 MPa or more.

7. The cleaning device of claim 1, wherein the blade includes rubber.

8. The cleaning device of claim 7, wherein the blade has a JISA hardness of 60 degrees to 80 degrees.

9. The cleaning device of claim 8, wherein the blade has a rebound resilience of 30 percent or less at 23° C.

10. The cleaning device of claim 1, wherein the blade is formed in a tabular shape elongated in an axial direction.

11. The cleaning device of claim 10, wherein the obtuse angle is in a first corner area of the tabular shape and a right angle is in a second corner area of the tabular shape.

12. The cleaning device of claim 1, wherein the tip ridge portion is configured to press the surface to be cleaned with a linear pressure of 0.95 N/cm and with a surface pressure of 3.17 MPa to 9.50 MPa.

13. The cleaning device of claim 1, wherein the tip ridge portion is configured to press the surface to be cleaned with a linear pressure of 1.2 N/cm and with a surface pressure of 2.4 MPa to 12.0 MPa.

14. The cleaning device of claim 1, wherein the tip ridge portion is configured to press the surface to be cleaned with a linear pressure of 0.4 N/cm and with a surface pressure of 2.0 MPa to 4.0 MPa.

15. The cleaning device of claim 1, wherein a contact width between the tip ridge portion and the surface to be cleaned is configured to be within a range of 5 micrometers to 90 micrometers.

16. The cleaning device of claim 1, wherein a contact width between the tip ridge portion and the surface to be cleaned is configured to be 10 micrometers or more.

17. The cleaning device of claim 1, wherein the tip ridge portion includes a material to lower the coefficient of friction between the tip ridge portion and the surface to be cleaned.

18. The cleaning device of claim 17, wherein the material is fluorine.

19. A blade, comprising:

a cut surface provided by obliquely cutting a part of a tip surface to set an angle forming a tip ridge portion of the blade as an obtuse angle, the cut surface being less than an entirety of the tip surface, wherein the tip ridge portion is configured to be pressed to a surface to be cleaned, and wherein the obtuse angle is set by removing one or more sections of the blade with total dimensions of 100 micrometers in a length direction and 200 micrometers in a thickness direction.

20. A cleaning device that cleans a toner on an image carrier, the cleaning device comprising:

a blade; and a support member that supports the blade, wherein the blade includes:

a top surface;

a bottom surface substantially parallel to the top surface; and a slanted surface provided at only one corner area of the blade, said slanted surface having two ends and forming a tip ridge portion of the blade at one end at an intersection of the top surface and the slanted surface and having an obtuse angle relative to the top surface, the slanted surface indirectly connecting the top surface and the bottom surface, and wherein the support member is configured to support the blade such that only the tip ridge portion presses a surface of the image carrier.

* * * * *